US006187527B1

(12) United States Patent
Haraguchi et al.

(10) Patent No.: US 6,187,527 B1
(45) Date of Patent: Feb. 13, 2001

(54) SILVER HALIDE COLOR REVERSAL LIGHTSENSITIVE MATERIAL

(75) Inventors: Nobuyuki Haraguchi; Katsuro Nagaoka, both of Minami-Ashigara (JP)

(73) Assignee: Fuji Photo Film Co., Ltd., Kanagawa (JP)

( * ) Notice: Under 35 U.S.C. 154(b), the term of this patent shall be extended for 0 days.

(21) Appl. No.: 09/503,336

(22) Filed: Feb. 14, 2000

(30) Foreign Application Priority Data

Feb. 16, 1999 (JP) ..... 11-037180

(51) Int. Cl.[7] ..... G03C 1/40
(52) U.S. Cl. ..... 430/596; 430/559
(58) Field of Search ..... 430/596, 559

(56) References Cited

U.S. PATENT DOCUMENTS 5,248,588 * 9/1993 Nagoaka ..... 430/605
5,437,968 * 8/1995 Nagoaka ..... 430/505
5,563,027 * 10/1996 Johnston et al. ..... 430/509

FOREIGN PATENT DOCUMENTS 7225459 8/1995 (JP) .

* cited by examiner

*Primary Examiner*—Hoa Van Le
(74) *Attorney, Agent, or Firm*—Birch, Stewart, Kolasch & Birch, LLP

(57) ABSTRACT

A silver halide color reversal lightsensitive material comprising a transparent support and, superimposed thereon, a blue-sensitive emulsion layer unit, a green-sensitive emulsion layer unit and a red-sensitive emulsion layer unit, each of these units comprising at least two emulsion sub-layers having the same color sensitivity but different speeds from each other, wherein the material contains a yellow dye in an amount of 0.15 to 1.0 g/m$^2$ and satisfies the relationship:

$$0.9 \leqq \gamma'/\gamma \leqq 1.25$$

wherein $\gamma$ and $\gamma'$ each represent a point-gamma value of a portion of the material giving a magenta density of 1.0 when the material was subjected to a development processing comprising an image-wise exposure step, a black and white development step, a reversal processing step, a color development step and a desilvering step thereby forming color reversal images, provided that $\gamma$ is the point-gamma value attained when a period of the black and white development step was set to the standard period, and $\gamma'$ is the point-gamma value attained when the period of the black and white development step was prolonged to attain a higher speed of 0.5 log E.

12 Claims, No Drawings

SILVER HALIDE COLOR REVERSAL LIGHTSENSITIVE MATERIAL

BACKGROUND OF THE INVENTION

The present invention relates to a silver halide color reversal lightsensitive material. More particularly, the present invention is to provide a silver halide color reversal lightsensitive material having a push-processability favorable to users and relates to a silver halide color reversal lightsensitive material which is improved in sensitivity at high speed development, gradation, gradation balance and color balance.

In the color reversal image formation, a sensitivity regulation by prolonging the black and white development time during color reversal process is conducted in order to compensate for any under-exposure of a color photographic lightsensitive material. This sensitivity regulation is generally called "push-processing".

Various trials for enhancing the push-processability have been made. For example, the method of enhancing the push-processability with the use of a color reversal lightsensitive material in which a silver halide emulsion having fog nuclei inside silver halide grains is employed, is disclosed in Jpn. Pat. Appln. KOKAI Publication No. (hereinafter referred to as JP-A-) 59-214852, JP-A's-60-170849, 60-170850, 60-170851, 60-170852, 60-170853, 63-193147 and 9-218485. Further, the method of enhancing the push-processability with the use of a color reversal lightsensitive material having colloidal silver contained in an interlayer combined with a silver halide emulsion layer, is disclosed in U.S. Pat. No. 5,298,369 (JP-A-5-257243).

However, although the method of improving, for example, the sensitivity, highest density and color balance in the push-processing of a color reversal lightsensitive material is disclosed in the above literature, these techniques cannot be stated as being satisfactory with respect to the improvement of gradation and gradation balance when push-processing is performed.

Moreover, JP-A-7-225459 discloses the technique of improving the gradation balance and gradation change at push-processing by the use of a DIR compound, colloidal silver and an emulsion of internal latent image type. This push-processing is intended to attain a speed increase to about twofold, or pays attention to the gradation, color balance and gradation balance at a push-processing for attaining a speed increase to fourfold or more, or is intended to effect a sensitization with a speed of twofold (0.3 log E or less). However, the push-processing practically employed by most users ranges from 1.4-fold to less than fourfold in speed, and it has not yet been elucidated what kind of characteristic values must be possessed by a color reversal film capable of producing like images irrespective of any speed set within this range in the use thereof or how these can be attained.

BRIEF SUMMARY OF THE INVENTION

The object of the present invention is to provide a color reversal lightsensitive material improved especially in the gradation, gradation balance and color balance at push-processing.

DETAILED DESCRIPTION OF THE INVENTION

The inventors have conducted extensive and intensive studies and, as a result, the above object of the present invention has been attained by the following:

(1) A silver halide color reversal lightsensitive material comprising a transparent support and, superimposed thereon, a blue-sensitive emulsion layer unit, a green-sensitive emulsion layer unit and a red-sensitive emulsion layer unit, each of these units comprising at least two emulsion sub-layers having the same color sensitivity but different speeds from each other, wherein said material contains a yellow dye in an amount of 0.15 to 1.0 g/m$^2$ and satisfies the relationship:

$$0.9 \leqq \gamma'/\gamma \leqq 1.25$$

wherein γ and γ' each represent a point-gamma value of a portion of said material giving a magenta density of 1.0 when said material was subjected to a development processing comprising an image-wise exposure step, a black and white development step, a reversal processing step, a color development step and a desilvering step thereby forming color reversal images, provided that γ is the point-gamma value attained when a period of the black and white development step was set to a standard period, and γ' is the point-gamma value attained when the period of the black and white development step was prolonged to attain a higher speed of 0.5 log E;

(2) The material as recited in item (1) above, wherein said material comprises means for releasing a development inhibitor during the development processing;

(3) The material as recited in item (2) above, wherein said means for releasing a development inhibitor is a DIR compound represented by the general formula (I):

$$A—(L)_n—(G)_m—(Time)_t \mathbf{13} X \quad (I)$$

wherein A represents a redox mother nucleus or a precursor thereof and represents a group oxidized during the development processing to thereby enable, for the first time, splitting off —(Time)$_t$—X, Time represents a group that can release X after —(Time)$_t$—X is released, X represents a development inhibitor, L represents a divalent linkage group, G represents an acid group, and each of n, m and t is 0 or 1, provided that m is not 0 when n=1;

(4) The material as recited in any of items (1) to (3) above, wherein $1\times10^{-4}$ to $5\times10^{-3}$ g/m$^2$ of at least one compound selected from the group consisting of compounds represented by the general formula (II) given below and compounds that selectively adsorb onto (100) faces of each silver halide grain, is contained in at least one sub-layer having the lowest speed, (II)

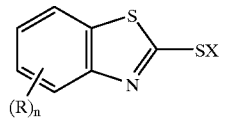

wherein X represents hydrogen or an alkali metal atom, R represents hydrogen, a halogen or an alkyl group having 1 to 5 carbon atoms, and n represents an integer from 1 to 4;

(5) The material as recited in any of items (1) to (4) above, wherein colloidal silver is further contained in at least one layer selected from the group consisting of a sub-layer having the lowest speed and a nonlightsensitive layer next to the sub-layer having the lowest speed; or (6) A silver halide color reversal lightsensitive material comprising a transparent support and, superimposed thereon, a blue-sensitive emulsion layer unit, a green-sensitive emulsion layer unit and a red-sensitive emulsion layer unit, each of these units comprising at least two emulsion sub-layers having the same color sensitivity but different speeds from each other, wherein said material contains a yellow dye in an amount of 0.15 to 1.0 g/m$^2$ and contains $1\times10^{-4}$ to $5\times10^{-3}$ g/m$^2$ of at least one compound selected from the group consisting of compounds represented by the general formula (II) given below and compounds that selectively adsorb onto (100) faces of silver halide grains, in at least one sub-layer having the lowest speed, (II)

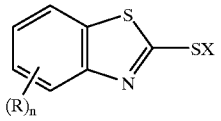

wherein X represents hydrogen or an alkali metal atom, R represents hydrogen, a halogen or an alkyl group having 1 to 5 carbon atoms, and n represents an integer from 1 to 4.

In the present invention, the point-gamma value is determined from a characteristic curve. The terminology "characteristic curve" used herein means a D—log E curve obtained by plotting D (color density) of the axis of ordinate against log E (E: exposure amount) of the axis of abscissa, which is described in detail in, for example, pages 501 to 509 of "The Theory of the Photographic Process" 4-th edition, edited by T. H. James, the disclosure of which is herein incorporated by reference.

The characteristic curve referred to in the present invention is determined in accordance with the following test method.

(1) Test conditions:

The test is performed in a perfect darkroom of 23±5° C. temperature and 50±20% relative humidity. Lightsensitive materials to be tested are allowed to stand still in this state for at least one hour before use.

(2) Exposure conditions:

The lightsensitive materials to be tested are exposed under the conditions specified in the international standard: ISO 2240 "Photography—Color reversal camera films—Determination of ISO speed".

(3) Processing conditions:

During the period from exposure to development processing, the lightsensitive materials are held at 23±5° C. in a relative humidity of 50±20%. The development processing is completed within 30 min to 6 hr of the exposure. The development processing is conducted through the following steps.

(Standard processing steps and solutions for use in the steps)

(Development processing A)

| Step | Time (min) | Temp. (° C.) | Tank vol. (L) | Replenishment rate (mL/m$^2$) |
|---|---|---|---|---|
| 1st. development | 6 | 38 | 12 | 2200 |
| 1st water washing | 2 | 38 | 4 | 7500 |
| reversal | 2 | 38 | 4 | 1100 |
| color development | 6 | 38 | 12 | 2200 |
| prebleaching | 2 | 38 | 4 | 1100 |

-continued (Development processing A)

| Step | Time (min) | Temp. (° C.) | Tank vol. (L) | Replenishment rate (mL/m$^2$) |
|---|---|---|---|---|
| bleaching | 6 | 38 | 12 | 220 |
| fixing | 4 | 38 | 8 | 1100 |
| 2nd water washing | 4 | 38 | 8 | 7500 |
| stabilizing | 1 | 25 | 2 | 1100 |

(L = liter, mL = milliliter).

The composition of each processing solution was as follows.

| <1st development solution> | <Tank soln.> | <Replenisher> |
|---|---|---|
| pentasodium nitrilo-N,N,N-trimethylene-phosphonate | 1.5 g | 1.5 g |
| pentasodium diethylenetriaminepentacetate | 2.0 g | 2.0 g |
| sodium sulfite | 30 g | 30 g |
| hydroquinone/potassium monosulfonate | 20 g | 20 g |
| potassium carbonate | 15 g | 20 g |
| potassium bicarbonate | 12 g | 15 g |
| 1-phenyl-4-methyl-4-hydroxymethyl-3-pyrazolidone | 1.5 g | 2.0 g |
| potassium bromide | 2.5 g | 1.4 g |
| potassium thiocyanate | 1.2 g | 1.2 g |
| potassium iodide | 2.0 mg | — |
| diethylene glycol | 13 g | 15 g |
| water | q.s. ad 1000 mL | |
| pH | 9.60 | 9.60 |

The pH was adjusted by the use of sulfuric acid or potassium hydroxide.

| <Reversal solution> | <Tank soln.> | <Replenisher> |
|---|---|---|
| pentasodium nitrilo-N,N,N-trimethylene-phosphonate | 3.0 g | same as left |
| stannous chloride dihydrate | 1.0 g | " |
| p-aminophenol | 0.1 g | " |
| sodium hydroxide | 8 g | " |
| glacial acetic acid | 15 mL | " |
| water | q.s. ad 1000 mL | |
| pH | 6.00 | same as left |

This pH was adjusted by the use of acetic acid or sodium hydroxide.

| <Color developer> | <Tank soln.> | <Replenisher> |
|---|---|---|
| pentasodium nitrilo-N,N,N-trimethylene-phosphonate | 2.0 g | 2.0 g |
| sodium sulfite | 7.0 g | 7.0 g |
| trisodium phosphate dodecahydrate | 36 g | 36 g |
| potassium bromide | 1.0 g | — |
| potassium iodide | 90 mg | — |
| sodium hydroxide | 3.0 g | 3.0 g |
| citrazinic acid | 1.5 g | 1.5 g |

-continued

| <Color developer> | <Tank soln.> | <Replenisher> |
|---|---|---|
| N-ethyl-N-(β-methanesulfonamidoethyl)-3-methyl-4-aminoaniline 3/2 sulfate monohydrate | 11 g | 11 g |
| 3,6-dithiaoctane-1,8-diol | 1.0 g | 1.0 g |
| water | q.s. ad 1000 mL | |
| pH | 11.80 | 12.00 |

This pH was adjusted by the use of sulfuric acid or potassium hydroxide.

| <Prebleaching solution> | <Tank soln.> | <Replenisher> |
|---|---|---|
| disodium ethylenediaminetetraacetate dihydrate | 8.0 g | 8.0 g |
| sodium sulfite | 6.0 g | 8.0 g |
| 1-thioglycerol | 0.4 g | 0.4 g |
| formaldehyde/sodium bisulfite adduct | 30 g | 35 g |
| water | q.s. ad 1000 mL | |
| pH | 6.30 | 6.10 |

This pH was adjusted by the use of acetic acid or sodium hydroxide.

| <Bleaching solution> | <Tank soln.> | <Replenisher> |
|---|---|---|
| disodium ethylenediaminetetraacetate dihydrate | 2.0 g | 4.0 g |
| Fe(III) ammonium ethylenediaminetetraacetate dihydrate | 120 g | 240 g |
| potassium bromide | 100 g | 200 g |
| ammonium nitrate | 10 g | 20 g |
| water | q.s. ad 1000 mL | |
| pH | 5.70 | 5.50 |

This pH was adjusted by the use of nitric acid or sodium hydroxide.

| <Fixing solution> | <Tank soln.> | <Replenisher> |
|---|---|---|
| ammonium thiosulfate | 80 g | same as left |
| sodium sulfite | 5.0 g | " |
| sodium bisulfite | 5.0 g | " |
| water | q.s. ad 1000 mL | |
| pH | 6.60 | same as left |

This pH was adjusted by the use of acetic acid or aqueous ammonia.

| <Stabilizer> | <Tank soln.> | <Replenisher> |
|---|---|---|
| 1,2-benzoisothiazolin-3-one | 0.02 g | 0.03 g |
| polyoxyethylene p-monononylphenyl ether (av. deg. of polymn. 10) | 0.3 g | 0.3 g |
| polymaleic acid (av. mol. wt. 2,000) | 0.1 g | 0.15 g |
| water | q.s. ad 1000 mL | |
| pH | 7.0 | 7.0 |

(4) Density measurement

The density is expressed by $\log_{10}(\phi_0/\phi)$. $\phi_0$ represents a lighting luminous flux for density measurement, and $\phi$ represents a transmitted luminous flux at geodetic part. With respect to geometrical conditions for density measurement, it is standard to use parallel luminous flux to the normal direction as a lighting luminous flux and to use total luminous flux having been transmitted and extended over a half space as a transmitted luminous flux. When the density measurement is otherwise conducted, a correction by a standard density piece is effected. Further, in the measurement, each outer-most surface of a side having light-sensitive emulsion layers, is arranged opposite to a photoreceptor side. In the density measurement, three color densities are determined with the use of status AA filter for each of R (red), G (green) and B (blue) colors.

The characteristic curve is determined by plotting each of R, G and B densities obtained as a result of the above exposure, development processing and density measurement against values of common logarithm of exposure (log E).

The "transparent support" for use in the present invention is one whose magenta transmission density minimum as obtained by the above measuring method is in the range of 0 to 0.3, preferably 0 to 0.25, and more preferably 0 to 0.2.

"Point-gamma", as set forth on page 502 of the aforementioned literature, is generally determined by dD/dlog E and refers to a value of differential on a characteristic curve. In the present invention, the point-gamma value is defined as a value of differential on a magenta characteristic curve at such an exposure that the magenta color density is 1.0.

Among the above processing conditions, the "black and white development step recited in the claims of the specification corresponds to the "first development". Further, "reversal processing step" recited in the claims of the specification corresponds to "reversal". And "desilvering step" recited in the claims of the present specification corresponds to "prebleaching", "bleaching" and "fixing".

In the present invention, the "speed" is expressed by a logarithm whose base is 10 of inverse of exposure required to attain a magenta density of 1.0 in the above sequence of exposure, processing and density measurement.

Thus, "a higher speed of 0.5 log E" herein means as follows:

Assuming the speed of a photographic material was log Es when the material was subjected to the above mentioned standard processing, and the speed of the photographic material became log Ep when the material was subjected to a push-processing. In the case where log Ep/log Es=0.5, the material has a higher speed of 0.5 log E.

The lightsensitive material of the present invention is one capable of attaining a higher speed of 0.5 log E when the material is subjected to a higher speed development processing, compared with the case when the material is subjected to the above mentioned standard development processing.

In the present invention, the higher speed development processing is conducted by prolonging the first development time, among the above processing conditions, to a maximum of about thrice the standard processing.

In a preferred embodiment of the present invention, the push-processing is carried out by prolonging the black and white development time (first development) of widely employed E-6 color reversal processing or CR-56P color reversal processing, in which the black and white development processing time is generally 6 min.

In the present invention, the first development time for attaining a speed of 0.5 log E is preferably in the range of 8 to 18 min, more preferably 9 to 16 min, and most preferably 10 to 14 min.

It is requisite in the present invention that the ratio ($\gamma'/\gamma$) of point-gamma ($\gamma'$) at 1.0 magenta density exhibited when the higher speed development processing is conducted to point-gamma (γ) at 1.0 magenta density exhibited when the standard development processing is conducted, ranges from 0.9 to 1.25 on the magenta characteristic curve. It has been found that, when this characteristic value falls within the above range, users observing push-processed images can recognize images like those obtained by the standard processing and, thus, appropriate push-processability. The ratio γ'/γ is preferably in the range of 1.0 to 1.2, more preferably 1.0 to 1.15.

Although various selections can be contemplated for expressing the photographic performance at push-processing, for example, the speed change, gradation change and color balance change as measures, or regarding to which density attention must be directed as for each of the measures mentioned above, it has been found that the point-gamma at 1.0 magenta density is important for providing a preferred push-processability.

Among the point-gamma ratios of γ'/γ of three color-sensitive emulsion layer units, the difference between the greatest point-gamma ratio γ'/γ of a color-sensitive emulsion layer unit and the smaller point-gamma ratio γ'/γ, of another color-sensitive emulsion layer is preferably 0.2 or less, more preferably 0.1 or less, and most preferably 0.05 or less.

It is preferred that the color reversal lightsensitive material of the present invention be furnished with means for releasing a development inhibitor during the development processing for silver halide emulsion. In most color reversal lightsensitive materials, grains of silver halide emulsion contributing to the formation of low-density images are finer than grains of silver halide emulsion contributing to the formation of high-density images. On the other hand, since a large amount of silver halide solvent is employed in the development processing of color reversal lightsensitive materials, the low-density-side fine grain emulsion is dissolved in accordance with the prolongation of development time. Thus, it has been common that, at push-processing, the lowering of low-density-side color density, i.e., extent of increase of speed, is intense to thereby result in hard gradation and increase of the ratio γ'/γ. It has been found that the ratio γ'/γ can be lowered by providing the means for releasing a development inhibitor during development.

The "means for releasing a development inhibitor during development" can be:

(1) a DIR compound, or (2) a silver halide emulsion comprising a silver halide grains having a development inhibitor adsorbed there onto so that the development inhibitor is released when the silver halide is dissolved or developed.

In the present invention, it is preferred that the DIR compound represented by the general formula (I) be contained in the color reversal lightsensitive material.

The compound represented by the general formula (I) may be added to either or both of an arbitrary emulsion layer and nonlightsensitive layer. The addition amount is preferably in the range of 0.01 to 0.2 mmol/$m^2$.

The DIR compound represented by the general formula:

$$A—(L)_n—(G)_m—(Time)_t—X \quad (I)$$

will be described in detail below.

In the formula, the redox mother nucleus represented by A is one which complies with the Kendall Pelz rule, for example, hydroquinone, catechol, p-aminophenol, o-aminophenol, 1,2-naphthalenediol, 1,4-naphthalenediol, 1,6-naphthalenediol, 1,2-aminonaphthol, 1,4-aminonaphthol, 1,6-aminonaphthol, a gallic acid ester, a gallic acid amide, hydrazine, hydroxylamine, pyrazolidone or reductone.

The amino group of these redox mother nuclei is preferably substituted with a sulfonyl group having 1 to 25 carbon atoms or an acyl group having 1 to 25 carbon atoms. The sulfonyl group can be a substituted or unsubstituted aliphatic sulfonyl group or aromatic sulfonyl group. The acyl group can be a substituted or unsubstituted aliphatic acyl group or aromatic acyl group. The hydroxyl group or amino group as a constituent of the redox mother nucleus represented by A may be protected by a protective group capable of being removed at the development processing. The protective group can be, for example, one having 1 to 25 carbon atoms, such as an acyl group, an alkoxycarbonyl group, a carbamoyl group or any of those listed in JP-A's-59-197037 and 59-201057, the disclosures of which are herein incorporated by reference. Further, this protective group, if possible, may be bonded with the following substituent of A to thereby form a 5-, 6- or 7-membered ring.

In the redox mother nucleus represented by A, each position capable of substitution may be substituted with a substituent. This substituent can be, for example, a halogen atom or one having 1 to 25 carbon atoms such as an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, a cyano group, an acyl group, a carboxyl group, a sulfo group, a nitro group, a heterocyclic residue or a group represented by the following formula (1a) below, wherein each of L, G, Time, X, n, m and t have the same meaning as defined in the general formula (I). These substituents that substitute the redox mother nucleus represented by A may further be substituted with those mentioned above. Further, these substituents, if possible, may be bonded with each other to thereby form a saturated or unsaturated carbon ring or a saturated or unsaturated heterocycle.

Formula (1a):

$$—(L)_n—(G)_m—(Time)_t—X.$$

Preferred examples of A include hydroquinone, catechol, p-aminophenol, o-aminophenol, 1,4-naphthalenediol, 1,4-aminonaphthol, a gallic acid ester, a gallic acid amide and hydrazine. Hydroquinone, catechol, p-aminophenol, o-aminophenol and hydrazine are more preferred as A. Hydroquinone and hydrazine are most preferred.

In the formula (I), L represents a divalent linkage group, which can preferably be an alkylene, an alkenylene, an arylene, an oxyalkylene, an oxyarylene, an aminoalkyleneoxy, an aminoalkenyleneoxy, an aminoaryleneoxy or an oxygen atom.

G represents an acid group, which preferably is —CO—, —CO—CO—, —CS—, —SO—, —$SO_2$—. —P(=O)($OR^{21}$)— or —C(=$NR^{22}$)—. Wherein, $R^{21}$ represents an alkyl, an aryl or a heterocycle. $R^{22}$ is a hydrogen atom or has the same meaning as $R^{21}$. G is preferably —CO—, —CO—CO—, —P(=O)($OR^{21}$)— or —C(=$NR^{22}$)—, more preferably —CO— or —CO—CO—, and most preferably —CO—.

Each of n and m is 0 or 1. Which integer is preferred depends on the type of A. For example, when A is hydroquinone, catechol, aminophenol, naphthalenediol, aminonaphthol or a gallic acid compound, n=0 is preferred, and n=m=0 is more preferred. When A is hydrazine or hydroxylamine, n=0 and m=1 is preferred. When A is pyrazolidone, n=m=1 is preferred. Provided, however, that m cannot be 0 when n=1.

The group represented by —$(Time)_t$— is a group which is released as a compound represented by {—$(Time)_t$—

X}— only when the redox mother nucleus represented by A in the general formula (I) undergoes a redox reaction at the development processing to thereby form an oxidation product.

Time preferably attaches to G through a sulfur atom, a nitrogen atom, an oxygen atom or a selenium atom.

Time may represent a group capable of subsequently releasing X to thereby possess a function of timing regulation. Further, time may be a coupler which reacts with an oxidized product of a developer to thereby release X or may be a redox group.

When Time is a group having a function of timing regulation, the group can be any of those described in, for example, U.S. Pat. Nos. 4,248,962 and 4,409,323, GB No. 2,096,783, U.S. Pat. No. 4,146,396 and JP-A's-51-146828 and 57-56837, the disclosure of which are herein incorporated by reference. Time may be a combination of at least two groups selected from those described in these publications.

Preferred examples of timing regulation groups include the following.

(1) Groups utilizing a hemiacetal cleavage reaction:

These are, for example, groups described in U.S. Pat. No. 4,146,396, JP-A's-60-249148 and 60-249149, the disclosures of which are herein incorporated by reference, and represented by the following formula (T-1). In the formula, mark * represents a position bonded to the left side in the general formula (I), for example G, and mark ** represents a position bonded to the right side in the general formula (I), for example X.

(T-1)

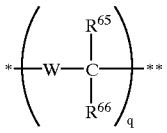

In the formula (T-1), W represents an oxygen atom, a sulfur atom or a group of the formula —$NR^{67}$—; each of $R^{65}$ and $R^{66}$ represents a hydrogen atom or a substituent; $R^{67}$ represents a substituent; and q is 1 or 2.

When q is 2, two —W—$CR^{65}(R^{66})$— groups represent the same species or species different from each other.

Typical examples of each of $R^{65}$ and $R^{66}$, these representing substituents, and $R^{67}$ include the groups of $R^{69}$—, $R^{69}CO$—, $R^{69}SO_2$—, $R^{69}NCO(R^{70})$— and $R^{69}N(R^{70})SO_2$—. Wherein, $R^{69}$ represents an aliphatic group, an aromatic group or a heterocyclic group. $R^{70}$ represents an aliphatic group, an aromatic group, a heterocyclic group or a hydrogen atom. The present invention also comprehends each of $R^{65}$, $R^{66}$ and $R^{67}$ represents a divalent group and two of them are linked to each other to thereby form a cyclic structure.

(2) Groups inducing a cleavage reaction with the use of an intramolecular nucleophilic substitution reaction:

These can be, for example, timing groups described in U.S. Pat. No. 4,248,962, the disclosure of which is incorporated by reference, which can be represented by the formula:

*—Nu—Link—E—** (T-2).

In the formula (T-2), mark * represents a position bonded to the left side in the general formula (I), and mark  represents a position bonded to the right side in the general formula (I). Nu represents a nucleophilic group, which is, for example, an oxygen atom or a sulfur atom. E represents an electrophilic group, which encounters a nucleophilic attack from Nu with the result that the bond with the mark  can be cleaved. Link represents a linkage group which provides such a steric association that an intramolecular nucleophilic substitution reaction can be effected by Nu and E.

(3) Groups inducing a cleavage reaction with the use of an electron transfer reaction along conjugated system:

These can be, for example, groups described in U.S. Pat. Nos. 4,409,323 and 4,421,845, the disclosures of which are herein incorporated by reference, and represented by the following formula (T-3).

(T-3)

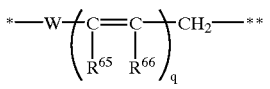

In the formula (T-3), the mark *, mark **, W, $R^{65}$, $R^{66}$ and q have the same meaning as specified in the formula (T-1).

(4) Groups utilizing a cleavage reaction by ester hydrolysis:

These can be, for example, linkage groups de scribed in German Offenlegungshrift 2,626,315, the disclosure of which is herein incorporated by reference and represented by the following formulae (T-4) and (T-5).

(T-4)

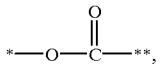

(T-5)

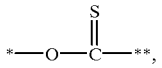

In the formulae (T-4) and (T-5), the mark * and mark ** have the same meaning as specified in the formula (T-1).

(5) Groups utilizing a cleavage reaction of iminoketal:

These can be, for example, linkage groups described in U.S. Pat. No. 4,546,073, the disclosure of which is herein incorporated by reference and represented by the following formula (T-6).

(T-6)

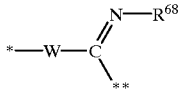

In the formula (T-6), the mark *, mark ** and W have the same meaning as specified in the formula (T-1). $R^{68}$ has the same meaning as $R^{67}$.

Examples of groups represented by Time, which function as a coupler or a redox group, include the following.

Couplers, for example, phenol type couplers are those bonded to G of the general formula (I) at the oxygen atom of the hydroxyl group thereof, from which a hydrogen atom is deleted. On the other hand, 5-pyrazolone type couplers are those bonded to G of the general formula (I) at the oxygen atom of the hydroxyl group of the interchange isomer form 5-hydroxypyrazole, from which a hydrogen atom is deleted. These each function as couplers only after being split from G and react with an oxidized product of a developer to thereby release X bonded to the coupling position thereof.

Preferred examples of Time functioning as couplers include those represented by the following formulae (C-1) to (C-4).

(C-1)

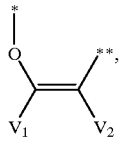

(C-2)

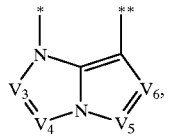

(C-3)

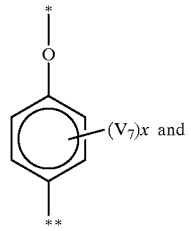

(C-4)

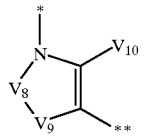

In the formulae, each of $V_1$ and $V_2$ represents a substituent, and each of $V_3$, $V_4$, $V_5$ and $V_6$ represents a nitrogen atom or a substituted or unsubstituted methine group. $V_7$ represents a substituent, and x is an integer of 0 to 4. When x is plural, $V_7$ groups may be the same or different from each other. Two $V_7$ groups may be linked with each other to thereby form a cyclic structure. $V_8$ represents —CO—, —$SO_2$—, an oxygen atom or a substituted imino group. $V_9$ represents a nonmetallic atom group which constitutes a 5 to 8-membered ring in combination with —$V_8$ and —N—C=C—. $V_{10}$ represents a hydrogen atom or a substituent. In the formulae, mark * represents a position bonded to the left side in the general formula (I), and mark ** represents a position bonded to the right side in the general formula (I).

In the general formula (I), when the group represented by Time is a redox group, it is preferably represented by the formula:

$$*—P—(Y{=}Z)_m—Q—B—** \quad \text{(R-1).}$$

In the formula, each of P and Q independently represents a hydrogen atom or a substituted or unsubstituted imino group. At least one of mYs and mZs represents a methine group having X of the general formula (I) as a substituent, while each of the other mYs and mZs represents a substituted or unsubstituted methine group or a nitrogen atom. m is an integer of 1 to 3, and m Ys and mZs may be the same or different from each other). B represents a hydrogen atom or a group which can be removed by an alkali. Mark * represents a position bonded to G of the general formula (I), and mark ** represents a position bonded to X of the general formula (I).

The present invention comprehends P, Y, Z, Q and B, of which any two are divalent substituents and linked with each other to thereby form a cyclic structure. For example, the formation of a benzene ring or pyridine ring by —$(Y{=}Z)_m$— is comprehended.

When P and Q represent substituted or unsubstituted imino groups, they are preferably imino groups substituted with a sulfonyl group or an acyl group. In this instance, P and Q are represented by the following formulae (N-1) and (N-2).

(N-1)

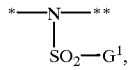

(N-2)

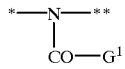

When Q is represented by the formula (N-1) or formula (N-2), mark ** represents a position bonded to B and mark * represents a position bonded to one free bonding hand of —$(Y{=}Z)_m$—. When P is represented by the formula (N-1) or formula (N-2), mark ** represents a position bonded to one free bonding hand of —$(Y{=}Z)_m$— and mark * represents a position bonded to G of the general formula (I).

In the formulae, the group represented by $G^1$ is an aliphatic group, an aromatic group or a heterocyclic group.

Among the groups represented by the formula (R-1), the especially preferred group is represented by the following formula (R-2) or (R-3).

(R-2)

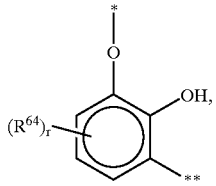

(R-3)

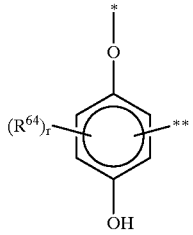

In the formulae, mark * represents a position bonded to G of the general formula (I), and mark ** represents a position bonded to X thereof.

$R^{64}$ represents a substituent, and r is an integer of 0 and 1 to 3. When r is 2 or greater, the two or more $R^{64}$ groups may be the same or different from each other. When two $R^{64}$ groups are substituents on neighboring carbon atoms, they may be divalent groups and linked to each other to thereby form a cyclic structure. These groups are also comprehended by the present invention.

In the general formula (I), X represents a development inhibitor. X can preferably be, for example, a compound having a mercapto group bonded to a heterocycle, represented by the formula (X-1), or a heterocyclic compound capable of forming an iminosilver, represented by the formula (X-2).

(X-1)

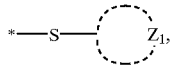

(X-2)

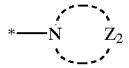

In the formulae, $Z_1$ represents a nonmetallic atom group required for forming a heterocycle of single ring or condensed rings, and $Z_2$ represents a nonmetallic atom group required for forming a heterocycle of single ring or condensed rings in combination with N. These heterocycles may have a substituent. Mark * represents a position bonded to Time. The heterocycle formed by $Z_1$ or $Z_2$ is more preferably a 5 to 8-membered heterocycle, most preferably a 5 or 6-membered heterocycle, containing at least one heteroatom selected from nitrogen, oxygen, sulfur and selenium.

Examples of the heterocycles formed by $Z_1$ include azoles (tetrazole, 1,2,4-triazole, 1,2,3-triazole, 1,3,4-thiadiazole, 1,3,4-oxadiazole, 1,3-thiazole, 1,3-oxazole, imidazole, benzothiazole, benzoxazole, benzimidazole, pyrrole, pyrazole and indazole), azaindenes (tetrazaindene, pentazaindene and triazaindene) and azines (pyrimidine, triazine, pyrazine and pyridazine).

Examples of the heterocycles formed by $Z_2$ include triazoles (1,2,4-triazole, benzotriazole and 1,2,3-triazole), indazoles, benzimdazoles, azaindenes (tetrazaindene and pentazaindene) and tetrazole.

Preferred substituents had by the development inhibitor represented by the formula (X-1) or (X-2) include halogen atoms, groups of $R^{77}$, $R^{78}O$—, $R^{77}S$—, $R^{77}OCO$—, $R^{77}OSO_2$—, cyano, nitro, $R^{77}SO_2$—, $R^{78}CO$—, $R^{77}COO$—, $R^{77}SO_2N(R^{78})$—, $R^{78}N(R^{79})SO_2$—, $R^{78}NR^{79}CO$—, $R^{77}(R^{78})C{=}N$—, $R^{77}(R^{78})N$—, $R^{78}CON(R^{79})$—, $R^{77}OCON(R^{78})$—, $R^{78}N(R^{79})CON(R^{80})$—, $R^{77}SO_2O$— and groups represented by the following formulae.

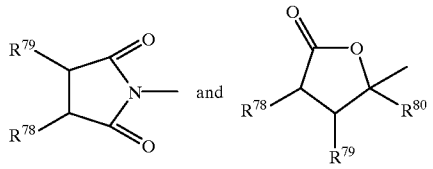

In the formulae, $R^{77}$ represents an aliphatic group, an aromatic group or a heterocyclic group. Each of $R^{78}$, $R^{79}$ and $R^{80}$ independently represents an aliphatic group, an aromatic group, a heterocyclic group or a hydrogen atom. When at least two groups represented by $R^{77}$, $R^{78}$, $R^{79}$ and $R^{80}$ are contained in a molecule, these may be linked with each other to thereby form a ring (for example, benzene ring).

Examples of the compounds represented by the formula (X-1) include substituted or unsubstituted mercaptoazoles (such as 1-phenyl-5-mercaptotetrazole, 1-propyl-5-mercaptotetrazole, 1-butyl-5mercaptotetrazole, 2-methylthio-5-mercapto-1,3,4-thiaziazole, 3-methyl-4-phenyl-5-mercapto-1,2,4-triazole, 1-(4-ethylcarbamoylphenyl)-2-mercaptoimidazole, 2-mercaptobenzoxazole, 2-mercaptobenzimidazole, 2-mercaptobenzothiazole, 2-mercaptobenzoxazole, 2-phenyl-5-mercapto-1,3,4-oxadiazole, 1-{3-(3-methylureido)phenyl}-5-mercaptotetrazole, 1-(4-nitrophenyl)-5-mercaptotetrazole and 5-(2-ethylhexanoylamino)-2-mercaptobenzimidazole), substituted or unsubstituted mercaptoazaindenes (such as 6-methyl-4-mercapto-1,3,3a-7-tetrazaindene and 4,6-dimethyl-2-mercapto-1,3,3a-7-tetrazaindene) and substituted or unsubstituted mercaptopyrimidines (such as 2-mercaptopyrimidine and 2-mercapto-4-methyl-6-hydroxypyrimidine).

Examples of the heterocyclic compounds capable of forming an iminosilver include substituted or unsubstituted triazoles (such as 1,2,4-triazole, benzotriazole, 5-methylbenzotriazole, 5-nitrobenzotriazole, 5-bromobenzotriazole, 5-n-butylbenzotriazole and 5,6-dimethylbenzotriazole), substituted or unsubstituted indazoles (such as indazole, 5-nitroindazole, 3-nitroindazole and 3-chloro-5-niroindazole) and substituted or unsubstituted benzimidazoles (such as 5-nitrobenzimidazole and 5,6-dichlorobenzimidazole).

X may be a compound which is split off from Time of the general formula (I) to once become a development inhibitive compound and which thereafter conducts some chemical reaction with developer components to thereby change to a compound having substantially no development inhibitivity or having extremely deteriorated development inhibitivity. Functional groups which undergo such a chemical reaction are, for example, an ester group, a carbonyl group, an imino group, an ammonium group, a Michael addition receptive group and an imino group.

Examples of such deactivation type development inhibitors include development inhibitor residues described in, for example, U.S. Pat. No. 4,477,563, and JP-A's-60-218644, 60-221750, 60-233650 and 61-11743, the disclosures of which are herein incorporated by reference.

Of these, compounds having an ester group are preferred, examples of which include 1-(3-phenoxycarbonylphenyl)-5-mercaptotetrazole, 1-(4-phenoxycarbonylphenyl)-5-mercaptotetrazole, 1-(3-maleinimidophenyl)-5-mercaptotetrazole 5-phenoxycarbonylbenzotriazole, 5-(4-cyanophenoxycarbonyl)benzotriazole, 2-phenoxycarbonylmethylthio-5-mercapto-1,3,4-thiadiazole, 5-nitro-3-phenoxycarbonylimidazole, 5-(2,3-dichloropropyloxycarbonyl)benzotriazole, 1-(4-benzoyloxyphenyl)-5-mercaptotetrazole, 5-(2-methanesulfonylethoxycarbonyl)-2-mercaptobenzothiazole, 5-cinnamoylaminobenzotriazole, 1-(3-vinylcarbonylphenyl)-5-mercaptotetrazole, 5-succinimidomethylbenzotriazole, 2-(4-succinimidophenyl)-5-mercapto-1,3,4-oxadiazole, 6-phenoxycarbonyl-2-mercaptobenzoxazole, 2-(1methoxycarbonylethylthio)-5-mercapto-1,3,4-thiadiazole, 2-butoxycarbonylmethoxycarbonylmethylthio-5-mercapto-1,3,4-thiadiazole, 2-(N-hexylcarbamoylmethoxycarbonylmethylthio)-5-mercapto-1,3,4-thiadiazole and 5-butoxycarbonylmethoxycarbonylbenzotriazole.

Among the compounds represented by the general formula (I), compounds represented by the following general formulae (III) and (IV) are preferred.

(III)

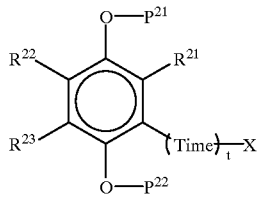

In the general formula (III), each of $R^{21}$ to $R^{23}$ represents a hydrogen atom or a group capable of substitution on hydroquinone nucleus. Each of $p^{21}$ and $p^{22}$ represents a hydrogen atom or a protective group which can be removed at the development processing. Time, X and t have the same meaning as in the general formula (I).

(IV)

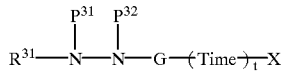

In the general formula (IV), $R^{31}$ represents an aryl group, a heterocyclic group, an alkyl group, an aralkyl group, an alkenyl group or an alkynyl group. Each of $p^{31}$ and $p^{32}$ represents a hydrogen atom or a protective group which can be removed at the development processing. G, Time, X and t have the same meaning as in the general formula (I).

The general formula (III) will be described in greater detail. The substituents represented by $R^{21}$ to $R^{23}$ can be, for example, those set forth as the substituents of A of the general formula (I). Each of $R^{22}$ and $R^{23}$ preferably represents a hydrogen atom, an alkylthio group, an arylthio group, an alkoxy group, an aryloxy group, an amido group, a sulfonamido group, an alkoxycarbonylamino group or a ureido group; and more preferably represents a hydrogen atom, an alkylthio group, an alkoxy group, an amido group, a sulfonamido group, an alkoxycarbonylamino group or a ureido group. $R^{22}$ and $R^{23}$ may be bonded with each other to thereby form a ring.

$R^{21}$ preferably represents a hydrogen atom, a carbamoyl group, an alkoxycarbonyl group, a sulfamoyl group, a sulfonyl group, a cyano group, an acyl group or a heterocyclic group; and more preferably represents a hydrogen atom, a carbamoyl group, an alkoxycarbonyl group, a sulfamoyl group or a cyano group.

The protective groups represented by $p^{21}$ and $p^{22}$ can be, for example, those set forth above with respect to the protection of hydroxyl group of A of the general formula (I). Preferably, the protective groups can be, for example, hydrolyzable groups such as an acyl group, an alkoxycarbonyl group, an aryloxycarbonyl group, a carbamoyl group, an imidoyl group, an oxazolyl group and a sulfonyl group; precursor groups of the type utilizing reverse Michael reaction, described in U.S. Pat. No. 4,009,029, the disclosure of which is herein incorporated by reference; precursor groups of the type utilizing anions generated as a result of ring cleavage reaction as an intramolecular nucleophilic group, described in U.S. Pat. No. 4,310,612, the disclosure of which is herein incorporated by reference; precursor groups which induce cleavage reaction by an electron transfer of anions through conjugated system, described in U.S. Pat. Nos. 3,674,478, 3,932,480 and 3,993,661, the disclosures of which are herein incorporated by reference; precursor groups which induce cleavage reaction by an electron transfer of anions resulting from ring cleavage and subsequent reaction, described in U.S. Pat. No. 4,335,200, the disclosure of which is herein incorporated by reference; and precursor groups utilizing imidomethyl groups, described in U.S. Pat. Nos. 4,363,865 and 4,410,618, the disclosures of which are herein incorporated by reference.

It is preferred that each of $p^{21}$ and $p^{22}$ represent a hydrogen atom.

X is preferably selected from mercaptoazoles and benzotriazoles. Especially preferred mercaptoazoles are mercaptotetrazoles, 5—mercapto-1,3,4-thiadiazoles and 5-mercapto-1,3,4-oxadiazoles.

X is most preferably any of 5-mercapto-1,3,4-thiadiazoles.

Among the compounds of the general formula (III), the compounds represented by the following general formulae (IIIa) and (IIIb) are preferred.

(IIIa)

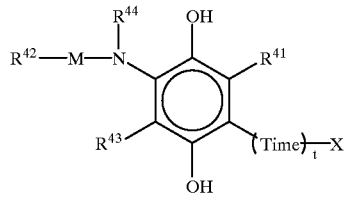

(IIIb)

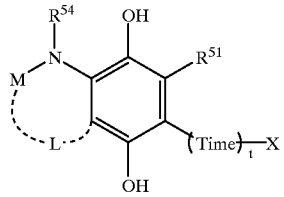

In the above formulae, $R^{42}$ represents an aliphatic group, an aromatic group or a heterocyclic group. M represents —CO—, —$SO_2$—, —N($R^{45}$)—CO—, —O—CO— or —N($R^{45}$)—$SO_2$—. Each of $R^{44}$, $R^{45}$ and $R^{54}$ represents a hydrogen atom, an alkyl group or an aryl group. L represents a divalent linkage group required for forming a 5 to 7-membered ring. $R^{41}$ and $R^{51}$ have the same meaning as $R^{21}$ of the general formula (II). $R^{43}$ has the same meaning as $R^{33}$ of the general formula (II). Time, X and t are as defined in the general formula (III).

Further, $R^{42}$ will be described in greater detail. The aliphatic group represented by $R^{42}$ is, for example, a linear, branched or cyclic alkyl, alkenyl or alkynyl group having 1 to 30 carbon atoms. The aromatic group represented thereby can be those having 6 to 30 carbon atoms, for example, a phenyl or naphthyl group. The heterocycle is a 3 to 12-membered ring containing at least one of nitrogen, oxygen and sulfur. These may be substituted with groups mentioned above in connection with the substituents of A.

The general formula (IV) will be described in greater detail.

The aryl group represented by $R^{31}$ has 6 to 20 carbon atoms, which can be, for example, phenyl or naphthyl. The heterocyclic group represented thereby is a 5 to 7-membered ring containing at least one of nitrogen, oxygen and sulfur, which can be, for example, furyl or pyridyl. The alkyl group represented thereby has 1 to 30 carbon atoms, which can be, for example, methyl, hexyl or octadecyl. The aralkyl group represented thereby has 7 to 30 carbon atoms, which can be, for example, benzyl or trityl. The alkenyl group represented thereby has 2 to 30 carbon atoms, which can be, for example, allyl. The alkynyl group represented thereby has 2 to 30 carbon atoms, which can be, for example, propargyl. $R^{31}$ preferably represents an aryl group, more preferably phenyl.

Examples of the protective groups represented by $p^{31}$ and $p^{32}$ include those mentioned above in connection with the protection of an amino group of A of the general formula (I). It is preferred that each of $p^{31}$ and $p^{32}$ represent a hydrogen atom.

G is preferably —CO—, and X is preferably as set forth above with respect to the general formula (I).

$R^{21}$ to $R^{23}$ of the general formula (III) and $R^{31}$ of the general formula (IV) may be substituted with a substituent. The substituent may have a group for imparting diffusion resistance, known as a ballast group, or a group adsorbable onto silver halide. Preferably, the substituent has a ballast group. When $R^{31}$ is a phenyl group, the substituent is preferably an electron donating group, for example, a sulfonamido group, an amido group, an alkoxy group or a ureido group. Furthermore, when $R^{21}$, $R^{22}$, $R^{23}$ or $R^{31}$ has a ballast group, it is especially preferred that a polar group such as a hydroxyl group, a carboxyl group or a sulfo group be present in its molecule.

Specific examples of the compounds represented by the general formula (I) will be set forth below for describing the feature of the present invention in more detail, which in no way limit the scope of compounds usable in the present invention.

I-1

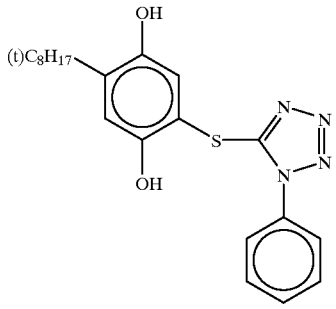

I-2

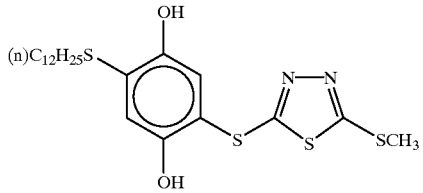

I-3

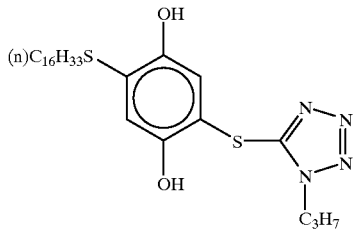

I-4

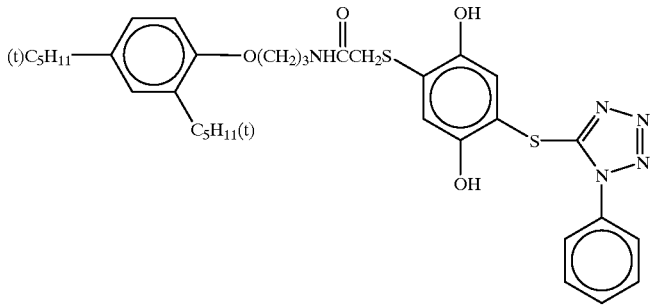

-continued
I-5
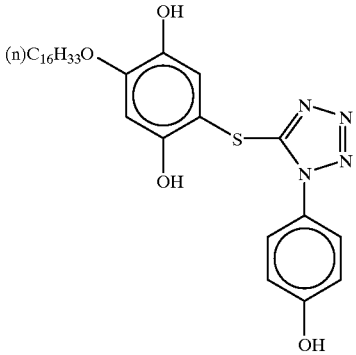
I-6
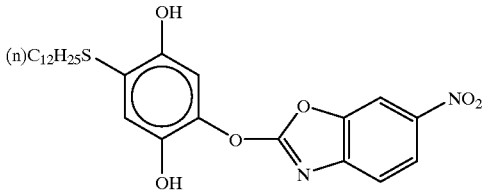
I-7
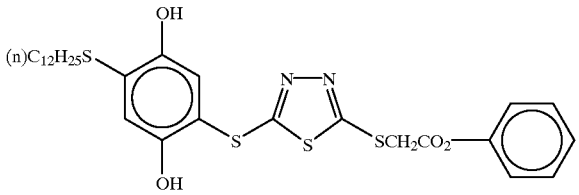
I-8
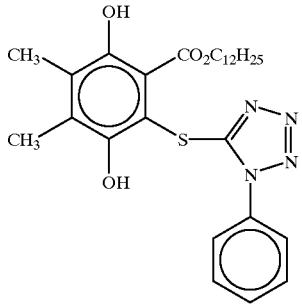
I-9
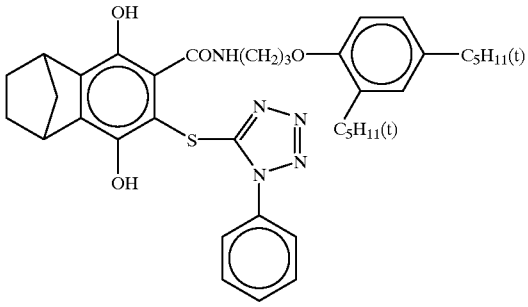

-continued
I-10
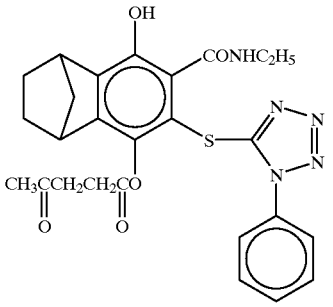
I-11
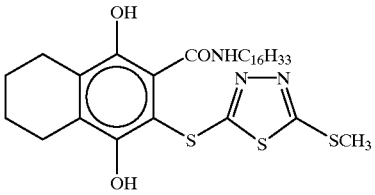
I-12
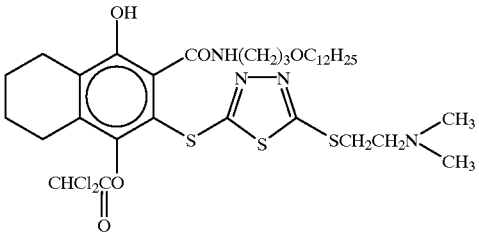
I-13
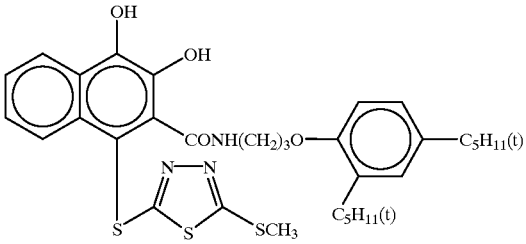
I-14
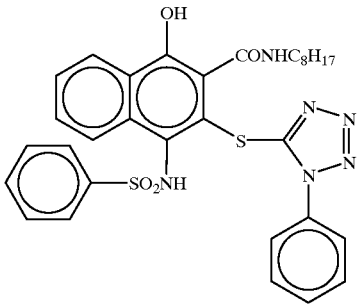

-continued
I-15
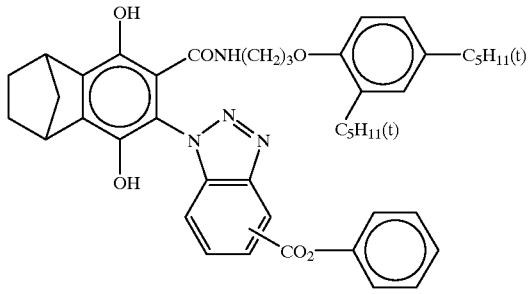
I-16
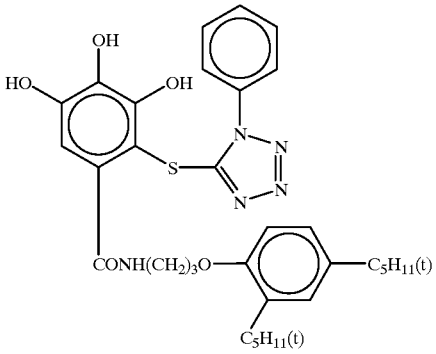
I-17
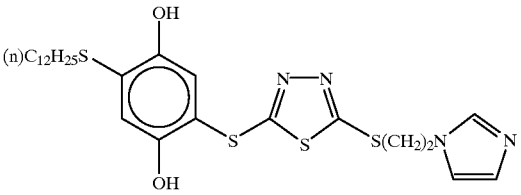
I-18
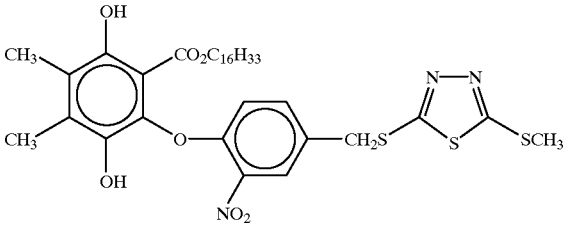
I-19
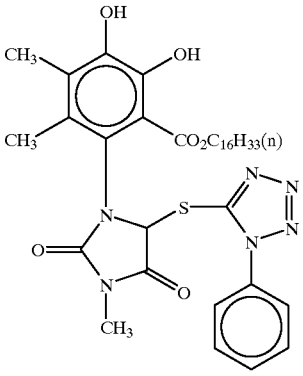

-continued
I-20
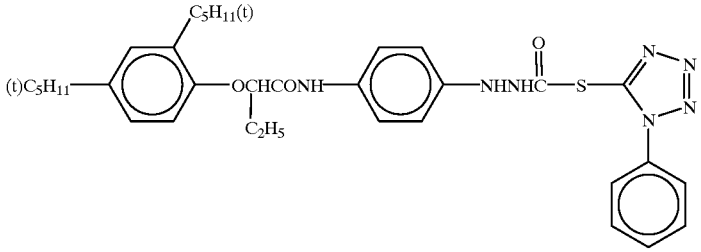
I-21
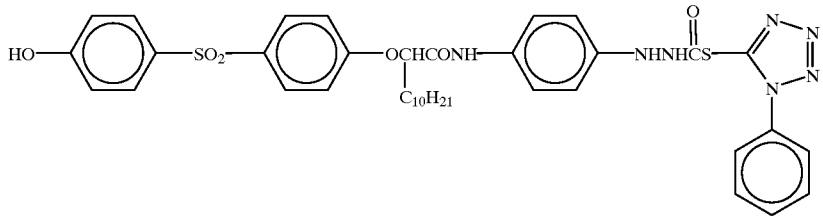
I-22
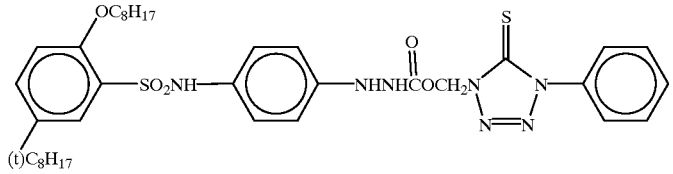
I-23
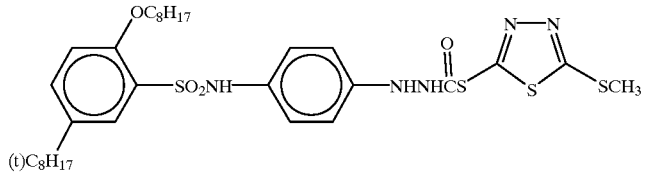
I-24
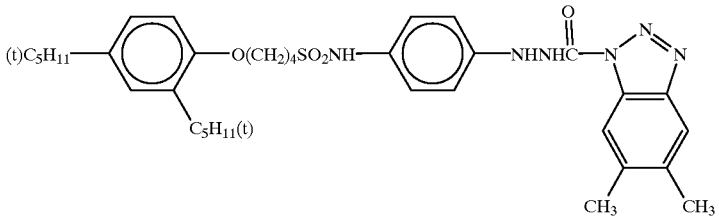
I-25
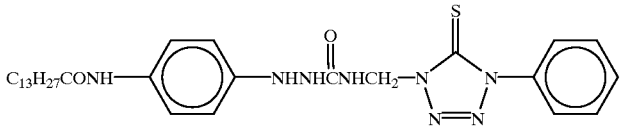
I-26
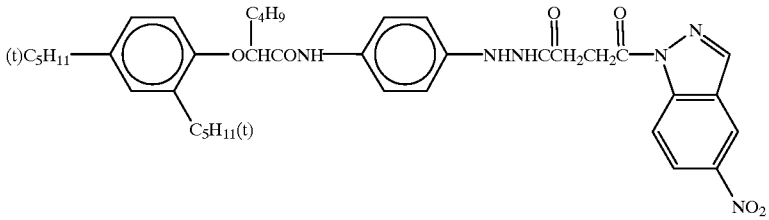

-continued
I-27
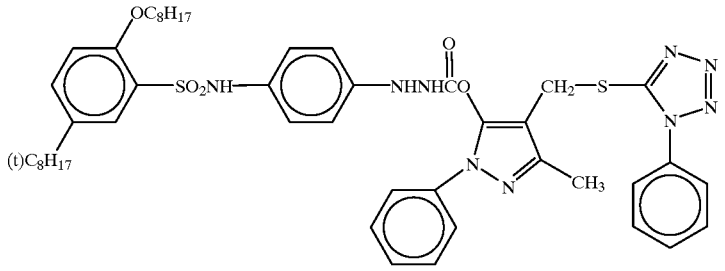
I-28
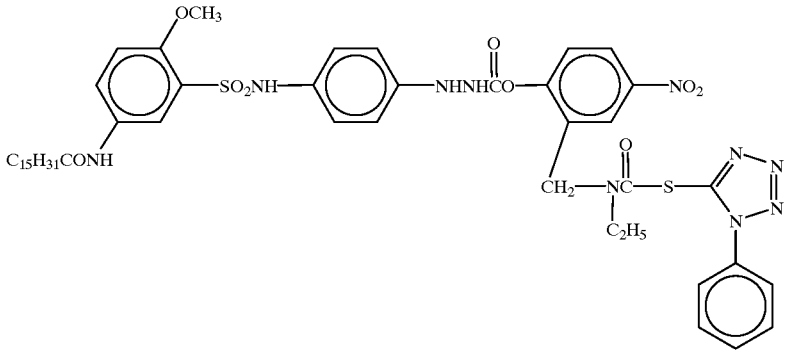
I-29
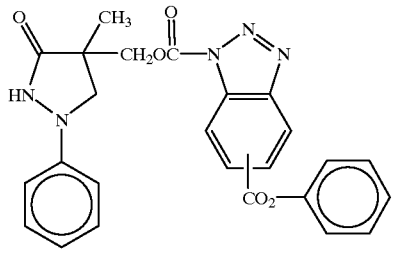
I-30
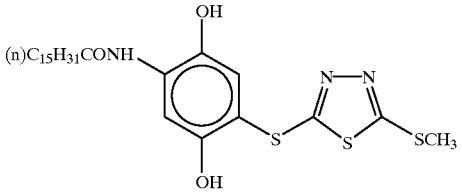
I-31
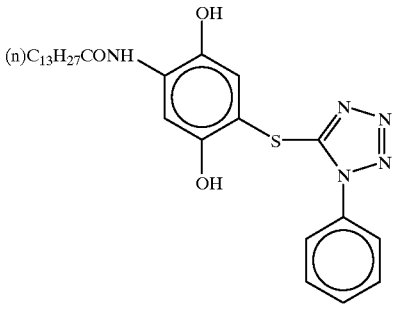

-continued
I-32
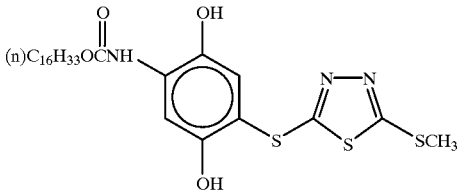
I-33
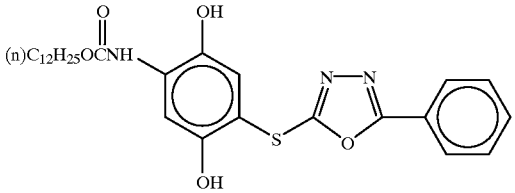
I-34
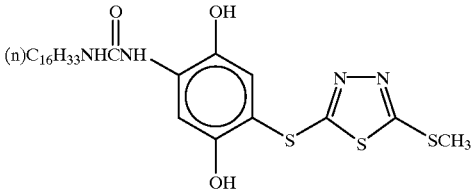
I-35
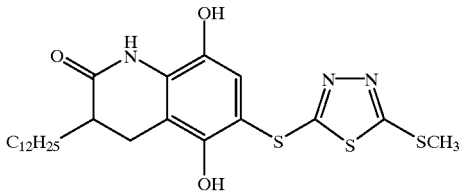
I-36
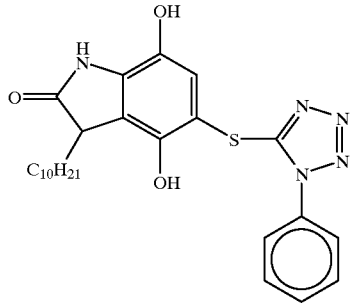
I-37
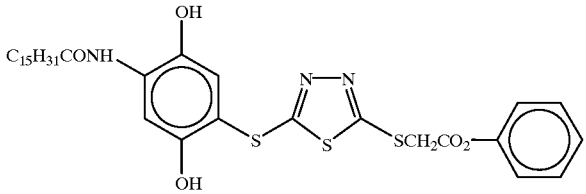
I-38
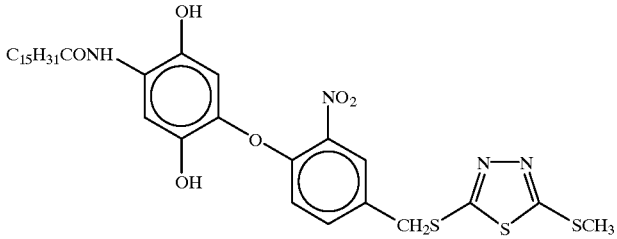

-continued
I-39
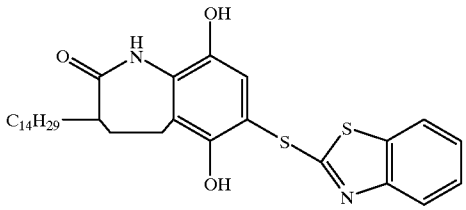
I-40
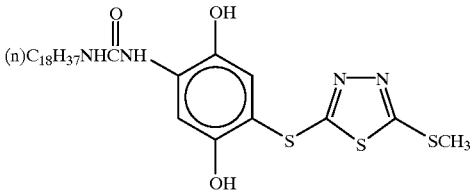
I-41
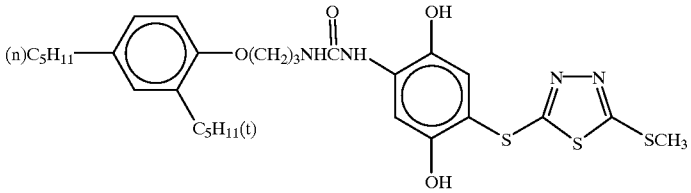
I-42
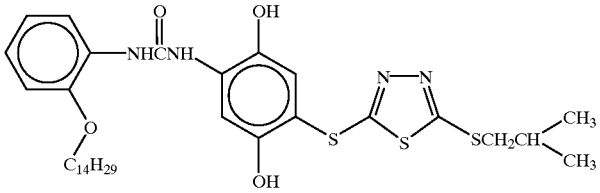
I-43
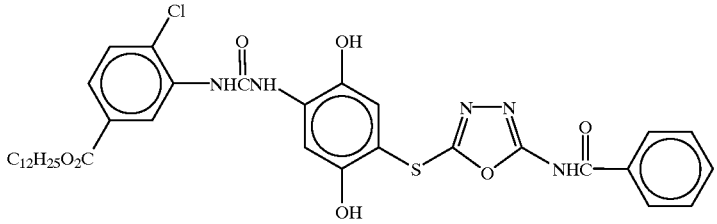
I-44
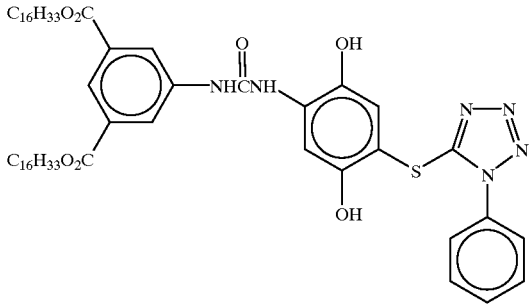
I-45
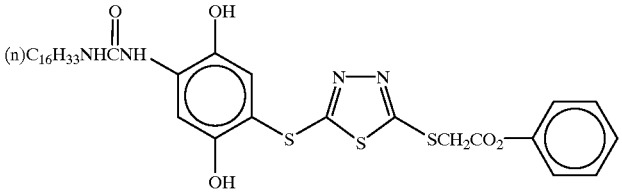

-continued
I-46
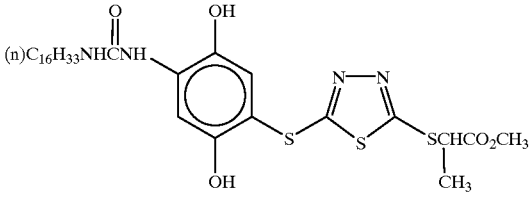
I-47
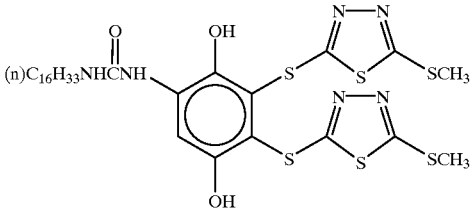
I-48
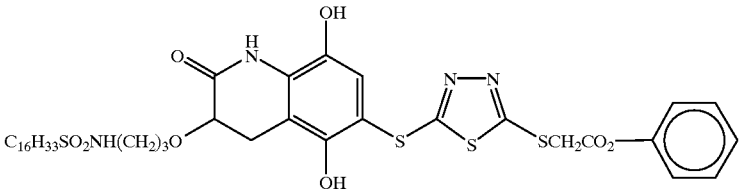
I-49
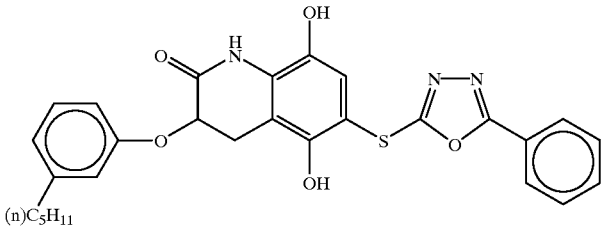
I-50
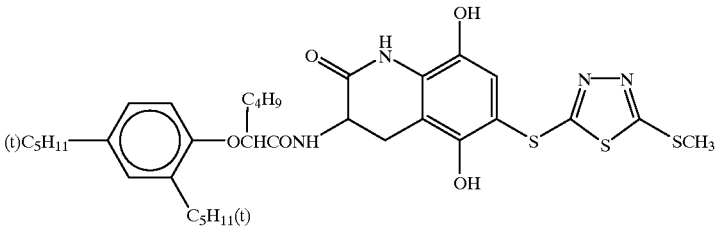
I-51
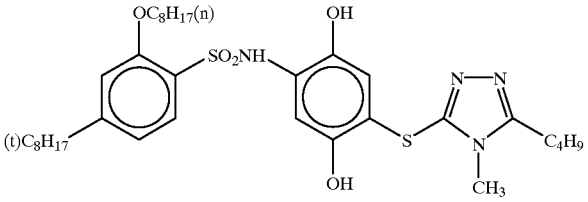
I-52
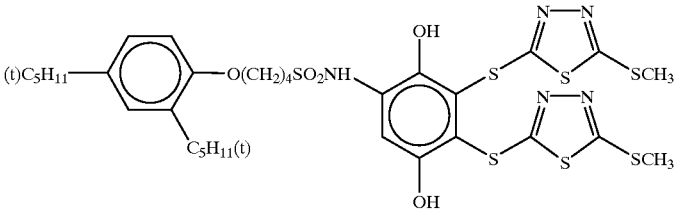

-continued
I-53
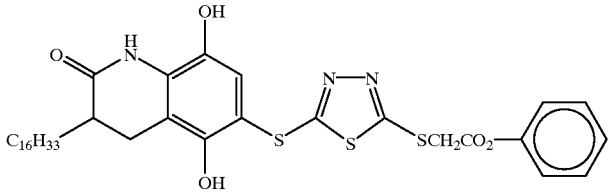
I-54
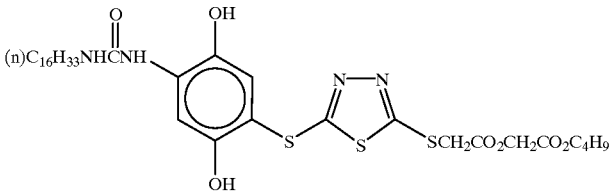
I-55
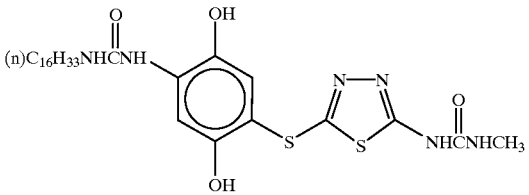
I-56
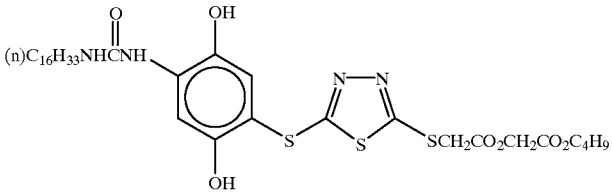
I-57
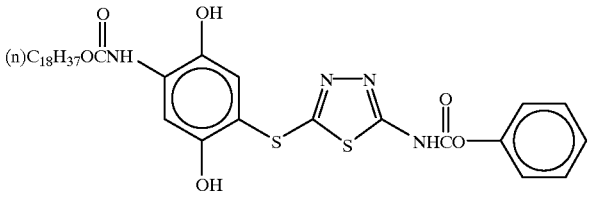
I-58
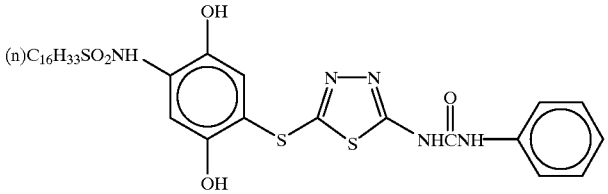
I-59
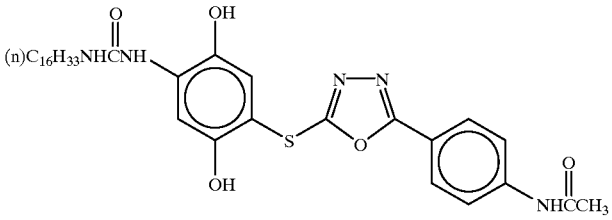

-continued

I-60

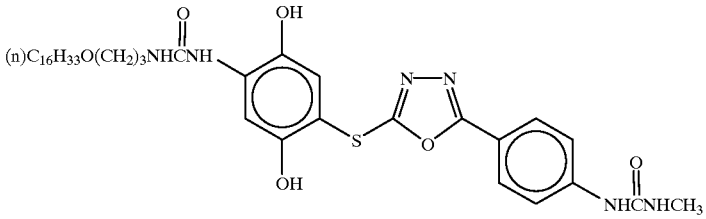

I-61

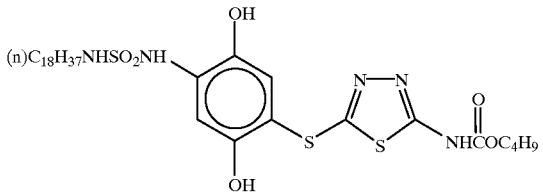

I-62

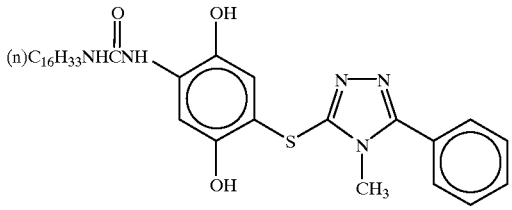

I-63

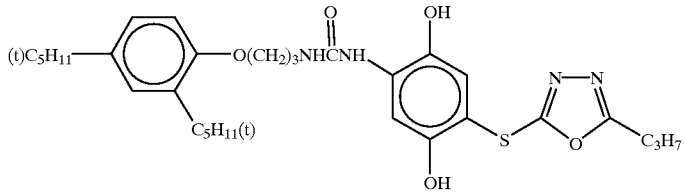

I-64

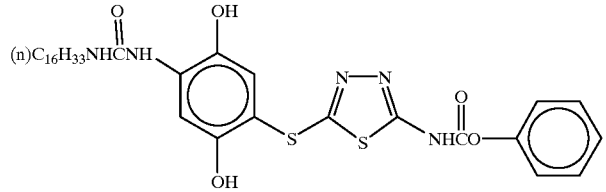

The compounds represented by the general formula (I) according to the present invention can be synthesized in the manner as described in, for example, JP-A's-49-129536, 52-57828, 60-21044, 60-233642, 60-233648, 61-18946, 61-156043, 61-213847, 61-230135, 61-236549, 62-62352, and 62-103639, U.S. Pat. Nos. 3,379,529, 3,620,746, 4,332,828, 4,377,634 and 4,684,604.

The compounds represented by the general formula (I) according to the present invention can be added as an emulsified dispersion to layers such as a layer containing a light-sensitive silver halide emulsion and a non color-sensitive layer including an interlayer and a protective layer. Preferred addition layers are an interlayer and a layer containing a light-sensitive silver halide emulsion. Especially, it is preferred that the addition be made to a layer containing a light sensitive silver halide emulsion layer. In the photographic material of the invention, the color-sensitive silver halide emulsion unit is composed of at least two sub-layers of different speeds. It is preferred that the addition be made to a lightsensitive emulsion sub-layer having the lowest speed from the viewpoint of inhibiting the dissolution of fine-grain emulsion as aforementioned.

Moreover, for minimizing the γ value differences among color-sensitive emulsion layer units, the addition is preferably made to at least two of the blue-, green- and red-sensitive emulsion layer units, more preferably to all of the color-sensitive emulsion layer units.

Therefore, it is the most preferred embodiment of the present invention to effect the addition to the lowest-speed sub-layers of all of the color-sensitive emulsion layer units.

The addition amount per sub-layer of the compounds represented by the general formula (I) according to the present invention is preferably in the range of 0.1 to 100 $mg/m^2$, more preferably 0.5 to 30 $mg/m^2$, and most preferably 1 to 10 $mg/m^2$.

In the present invention, addition of at least one of the compounds represented by the above mentioned general formula (II) to the lowest-speed sub-layer in the color-sensitive emulsion layer unit of the reversal lightsensitive material of the invention provides effective means for achieving the gradation as defined in the present invention at push-processing. The above compound is adsorbed onto the silver halide emulsion in the silver halide lightsensitive material, so that, when the silver halide emulsion is dissolved or developed, the compound is released into the lightsensitive material. Thus, the gradation relationship as defined in the present invention can be achieved.

The addition of the above compound may be conducted, for example, at the time of grain formation or subsequent desalting, or after subsequent re-dispersion and just prior to chemical sensitization, or at the time of chemical sensitization during the customary emulsion production process, or may be conducted during the emulsion coating process. However, from the viewpoint that the compound is adsorbed onto the silver halide prior to processing and released during processing, the addition is preferably conducted at the time of grain formation or desalting, or just prior to performing chemical sensitization, or during chemical sensitization. Most preferably, the addition is conducted after grain formation but prior to performing chemical sensitization. When the addition is conducted at the time of grain formation, it is preferred that the compound be added after the completion of addition to a reactor vessel of 50%, especially 80%, of total silver nitrate.

The addition amount after desalting is preferably in the range of $1\times10^{-6}$ to $1\times10^{-1}$ mol, more preferably $1\times10^{-5}$ to $1\times10^{-2}$ mol, and most preferably $1\times10^{-5}$ to $1\times10^{-3}$ mol, per mol of total silver halide of the emulsion that is contained in a light-sensitive emulsion layer. When the addition is conducted at the time of grain formation, the addition amount is preferably greater than that added after desalting. It is preferred that the addition amount be about 5 times that after desalting.

In the above general formula (II), X represents a hydrogen atom or an alkali metal atom (for example, lithium, sodium or potassium). Preferably, X represents a hydrogen atom, Na or K, more preferably, a hydrogen atom or Na.

R represents a hydrogen atom, a halogen atom (for example, fluorine, chlorine or bromine) or an alkyl group having 1 to 5 carbon atoms. The number of substituents represented by R, i.e., n in formula (II), is preferably 1 or 2.

Preferred examples of the compounds represented by the general formula (II) are set forth below.

II-1

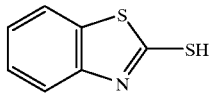

II-2

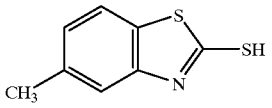

II-3

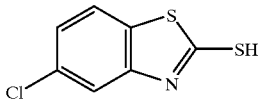

II-4

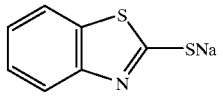

II-5

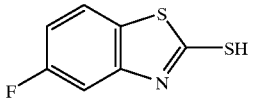

-continued

II-6

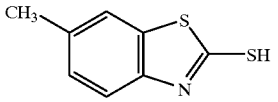

II-7

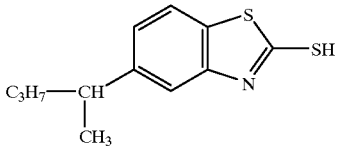

II-8

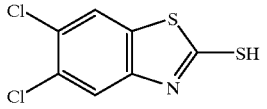

The compound represented by formula (II) may be synthesized by one of ordinary skill in the art.

The method of adding the compound represented by the general formula (II) may be the same as that of the (100) face selective compound to be described later.

Now, (100) face selective compounds will be described.

Compounds which are adsorbable onto silver halides are generally broadly classified into (100) face selective compounds and non-(100) face selective compounds, depending on the molecular skeleton and substituents thereof. Thus, the (100) face selectivity refers to a preference of initial adsorption of an added substance onto (100) faces of silver halide over non-(100) faces of silver halide. The terminology "(100) face selective compounds" used herein means compounds judged as having a (100) face selectivity in the following face selectivity discriminant method.

The discriminant method for crystal habit face selectivity of (100) face selective compounds will be described below.

Tetradecahedral 0.85 $\mu$m core silver bromide grains whose grain surface crystal habit (100) face/(111) face ratio is 52/48 are prepared, and various dyes and additives are adsorbed thereonto at $8\times10^{-4}$ mol/molAg, in the case where at least one dye is used without any other additive, the amount of the dye used for the adsorption is the half of the above mentioned amount, i.e., $4\times10^{-4}$ mol/molAg, followed by application of shell in a silver quantity equal to 125% of the silver quantity of the core emulsion grains. Compounds that can provide grain crystal habit (100)/(111) ratio is at least 65%, preferably at least 80%, are defined as the (100) face selective compounds. This is because, when highly selective compounds are adsorbed onto (100) faces, the subsequent grain growth tends to occur so as to bring about lamination on (111) faces with the result that (100) faces are formed.

The grain crystal habit ratio is obtained by preparing a specimen of grown grain crystal habit according to the replica method, observing the specimen through a transmission electron microscope, determining the proportion of (100) faces to surface area from the length of edges surrounding (100) faces and grain size, and making a calculation from the proportion.

The method of preparing the above tetradecahedral grains will be described below.

(Preparation of emulsion containing tetradecahedral grains)

26.4 cc of an aqueous silver nitrate solution (0.471 M) and 26.4 cc of an aqueous potassium bromide solution (0.477 M) were simultaneously added under agitation to 739 cc of an aqueous solution of 0.30 g of potassium bromide and 14.8 g of gelatin heated at 60° C. over a period of 1 min. Further, 5.28 g of ammonium nitrate and 4.5 cc of 25% aqueous ammonia were added. Thereafter, 739 cc of an aqueous silver nitrate solution (1.17 M) and an aqueous potassium bromide solution (1.30 M) were added over a period of 50 min while maintaining the silver potential at 28 mV. After the completion of grain formation, desalting was performed by the customary flocculation method followed by water washing, and gelatin and water were added so as to adjust the pH and pAg to 6.3 and 8.7, respectively. The thus obtained silver bromide emulsion A was a monodisperse tetradecahedral emulsion having a grain diameter of 0.85 $\mu$m and a grain diameter variation coefficient of 12%. The (100) face ratio of this emulsion was measured by the above method. It was found that the ratio was 52%.

The (100) face selective compound is not particularly limited and can be arbitrary as long as the (100) face selectivity is judged by the above discriminant method. The (100) face selective compound can be a mixture of a plurality of such compounds.

The (100) face selective compound can be either dissolved in water, an alcohol or other solvents or formed into a gelatin dispersion and can be added at any stage during grain formation, before or after chemical sensitization, or during emulsion coating. It is especially preferred that the addition be conducted after grain formation but before chemical sensitization.

The (100) face selective compounds may be synthesized by one of ordinary skill in the art.

The amount of the (100) face selective compounds to be added can be the same as the compound represented by formula (II).

Examples of the (100) face selective compounds will be set forth below, which are in no way limitative.

B-1

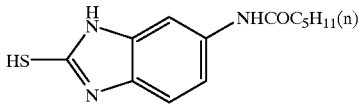

B-2

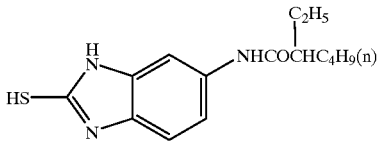

B-3

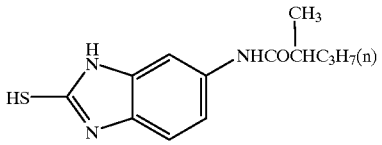

B-4

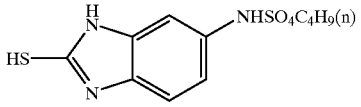

B-5

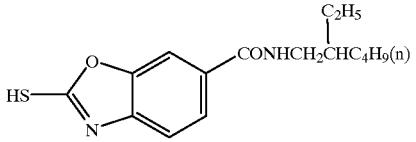

-continued

B-6

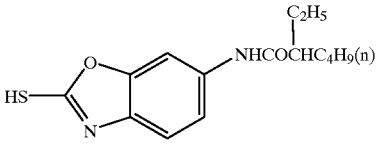

B-7

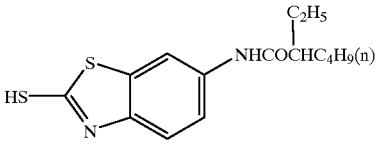

B-8

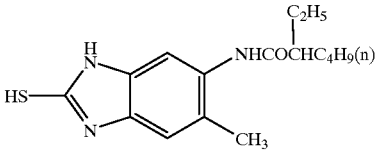

B-9

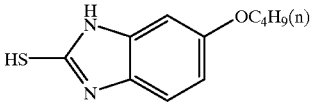

B-10

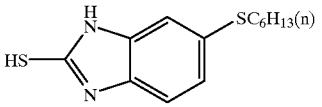

B-11

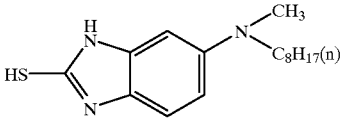

B-12

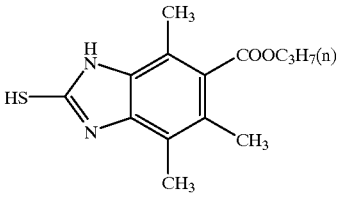

B-13

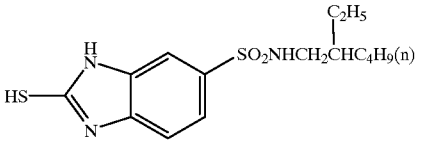

B-14

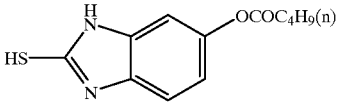

B-15

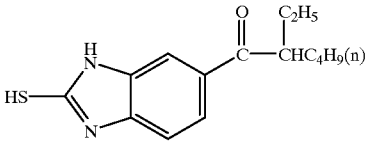

-continued

B-16

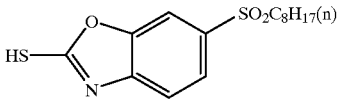

B-17

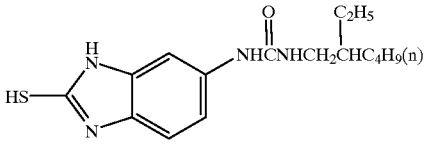

B-18

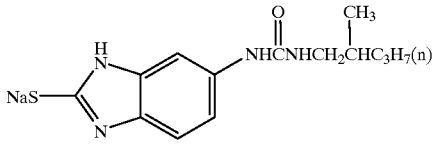

B-19

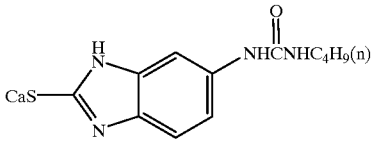

B-20

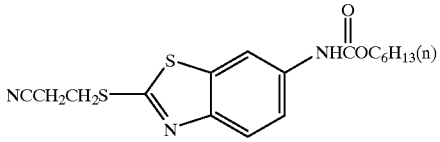

B-21

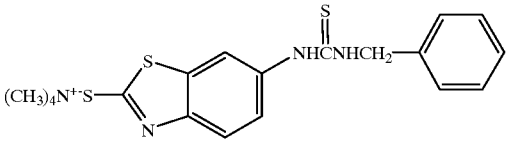

B-22

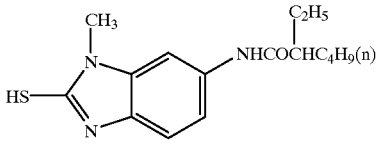

B-23

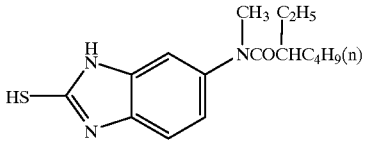

B-24

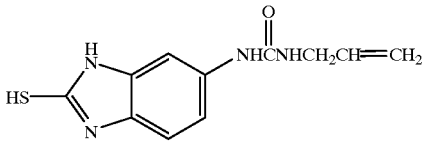

B-25

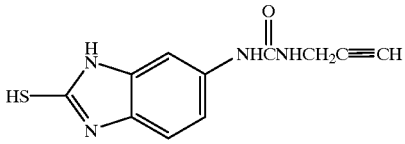

-continued

B-26

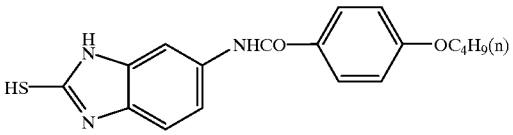

B-27

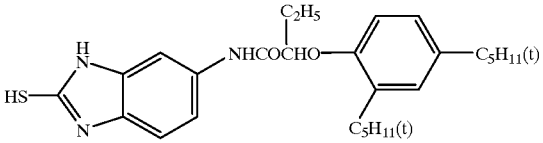

B-28

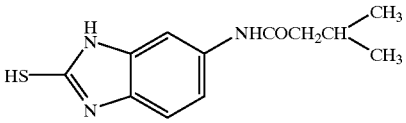

B-29

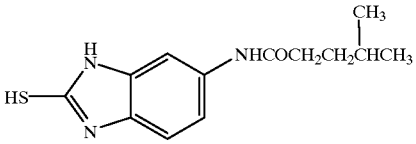

B-30

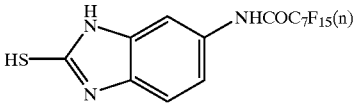

B-31

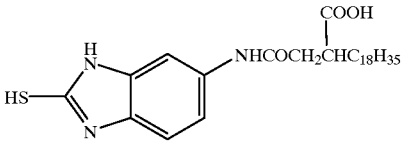

B-32

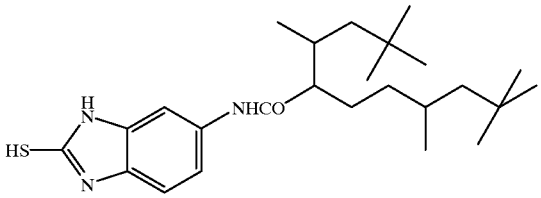

In the present invention, colloidal silver is preferably used in at least one sub-layer of the lowest speed among the color-sensitive emulsion layer units or at least one nonlight-sensitive layer neighboring thereto.

The layer preferably loaded with colloidal silver is the nonlightsensitive layer neighboring to the sub-layer of the lowest speed of each color-sensitive emulsion layer unit. In this instance, colloidal silver is preferably used in at least two nonlightsensitive layers, more preferably all of three nonlightsensitive layers, neighboring to the red-sensitive, green-sensitive and blue-sensitive layers, respectively.

Although this colloidal silver may have any of yellow, brown and black colors, it is preferred to use yellow one whose maximum absorption wavelength is in the range of 400 to 500 nm, and it is more preferred to use yellow one whose maximum absorption wavelength is in the range of 430 to 460 nm.

Preparation of various types of colloidal silver is described in, for example, "Colloidal Elements" written by Weiser and published by Wiley & Sons, New York in 1933 (yellow colloidal silver by the Carey Lea dextrin reduction method), or DE No. 1,096,193 (brown and black colloidal silvers), or U.S. Pat. No. 2,688,601 (blue colloidal silver).

In the present invention, the use amount of colloidal silver for each loaded layer is preferably in the range of 0.001 to 0.4 g/m$^2$, more preferably 0.003 to 0.1 g/m$^2$, and most preferably 0.003 to 0.01 g/m$^2$.

Although yellow colloidal silver may be used as a filter in color lightsensitive materials, the amount thereof is generally greater than the above preferred use amount of yellow colloidal silver. Therefore, the ordinary filter function cannot be fulfilled by the above preferred use amount of yellow colloidal silver, and accordingly it is needed to use an organic yellow compound, namely a yellow dye, as a yellow filter.

In the present invention, it is requisite that 0.15 to 1.0 g/m$^2$ of yellow dye be used as a yellow filter.

The yellow dye referred to herein is one having its maximum absorption wavelength in the wavelength range of 300 to 550 nm. The maximum absorption wavelength preferably ranges from 350 to 500 nm, more preferably 400 to 450 nm.

For removing nonimagewise hue after image formation having undergone development and other processing, this yellow dye must be dissolved away from the lightsensitive material or discolored in the lightsensitive material by development processing.

Although various yellow dyes composed of, for example, an inorganic compound, an organic compound, an oil soluble organic compound and a water soluble organic compound are known, the yellow dye is preferably composed of an organic compound. For avoiding any change of the condition of presence during the storage of the lightsensitive material, it is requisite that the yellow dye, even if it is oil soluble or water soluble, be dispersed in the solid state in the lightsensitive material. Yellow solid dispersed dye is most preferred.

Yellow solid dispersed dyes per se are known, which are described in, for example, JP-A-63-197943, EP No. 299435, U.S. Pat. Nos. 4,950,586 and 4,923,788, JP-A's-3-144438, 3-167546 and 9-106041, the disclosures of which are herein incorporated by reference.

Of these, the compound represented by the following general formula (V) is especially preferred.

(V)

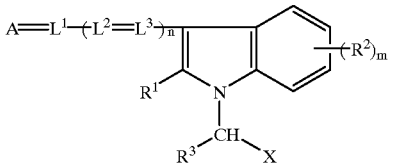

In the formula, A represents an acid nucleus, and each of $L^1$, $L^2$ and $L^3$ represents a substituted or unsubstituted methine group. Each of $R^1$ and $R^3$ represents a hydrogen atom or a substituent, including substituent atom. $R^2$ represents a substituent, including substituent atom. n is 0 or 1. m is an integer of 0 to 4. When m is an integer of 2 to 4, groups $R^2$ may be identical with or different from each other. X represents an electron attractive group whose Hammett's substituent constant σm is in the range of 0.3 to 1.5.

The compound represented by the general formula (V) will now be described in detail.

The acid nucleus represented by A is preferably 5-pyrazolone, isoxazolone, barbituric acid, thiobarbituric acid, pyrazolopyridone, rhodanine, hydantoin, thiohydantoin, oxazolidinedione, pyrazolidinedione, indanedione, hydroxypyridone, 1,2,3,4-tetrahydroquinoline-2,4-dione or 3-oxo-2,3-dihydrobenzo[d]thiophene-1,1-dioxide; more preferably 5-pyrazolone, hydroxypyridone, pyrazolopyridone, barbituric acid or isoxazolone; and most preferably 5-pyrazolone.

The compound preferred in the present invention is represented by the following general formula (Va).

(Va)

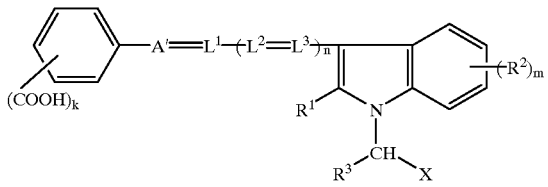

In the formula, k is 1, 2 or 3, and A' represents an acid nucleus residue. $L^1$, $L^2$, $L^3$, $R^1$, $R^2$, $R^3$, X, n and m have the same meaning as in the general formula (V).

The compound preferred in the present invention from the viewpoint of acid nucleus is represented by the following general formula (Vb).

(Vb)

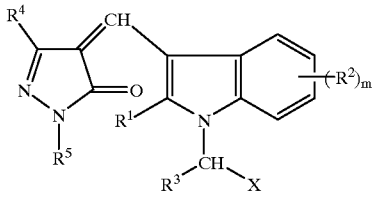

In the formula, each of $R^4$ and $R^5$ represents a hydrogen atom or a substituent, including substituent atom, provided that at least one thereof represents a substituent having a carboxyl group. $R^1$, $R^2$, $R^3$, X, and m have the same meaning as in the general formula (V).

Further, from the viewpoint of carboxyl bonding, at least one of $R^4$ and $R^5$, preferably $R^5$, of the general formula (Vb) is to be a carboxyl substituted phenyl group.

The electron attractive group whose Hammett's substituent constant σm, which is described in, for example, Chem. Rev., 91, 165 (1991), is in the range of 0.3 to 1.5, represented by X, can be, for example, a halogen atom (for example, fluorine atom (0.34 in σm value, same below), chlorine atom (0.37), bromine atom (0.39) or iodine atom (0.35)), a trifluoromethyl group (0.43), a cyano group (0.56), a formyl group (0.35), an acyl group (for example, acetyl (0.38)), an acyloxy group (for example, acetoxy (0.39)), a carboxyl group (0.37), an alkoxycarbonyl group (for example, methoxycarbonyl (0.37)), an aryloxycarbonyl group (for example, phenoxycarbonyl (0.37)), an alkylcarbamoyl group (for example, methylcarbamoyl (0.35)), a nitro group (0.71), an alkylsulfinyl group (for example, methylsulfinyl (0.52)), an alkylsulfonyl group (for example, methylsulfonyl (0.60)) or a sulfamoyl (0.53). This electron attractive group can more preferably be an alkoxycarbonyl group or a cyano group, most preferably an alkoxycarbonyl group.

The methine group represented by $L^1$, $L^2$ or $L^3$, although may have a substituent (for example, methyl group, ethyl group, cyano group or chlorine atom), is preferably an unsubstituted one. n is preferably 0.

Each of the substituents represented by $R^1$, $R^2$ and $R^3$ can be, for example, a substituted or unsubstituted alkyl group having 1 to 8 carbon atoms (for example, methyl, ethyl, propyl, isopropyl, n-butyl, isobutyl, sec-butyl, t-butyl, cyclohexyl, methoxyethyl, ethoxyethyl, ethoxycarbonylmethyl, ethoxycarbonylethyl, cyanoethyl, diethylaminoethyl, hydroxyethyl, chloroethyl or acetoxyethyl), a substituted or unsubstituted aralkyl group having 7 to 12 carbon atoms (for example, benzyl or 2-carboxybenzyl), a substituted or unsubstituted aryl group having 6 to 18 carbon atoms (for example, phenyl, 4-methylphenyl, 4-methoxyphenyl, 4-carboxyphenyl or 3,5-dicarboxyphenyl), a substituted or unsubstituted acyl group having 2 to 6 carbon atoms (for example, acetyl, propionyl, butanoyl or chloroacetyl), a substituted or unsubstituted sulfonyl group having 1 to 8 carbon atoms (for example, methanesulfonyl or p-toluenesulfonyl), an alkoxycarbonyl group having 2 to 6 carbon atoms (for example, methoxycarbonyl or ethoxycarbonyl), an aryloxycarbonyl group having 7 to 12 carbon atoms (for example, phenoxycarbonyl, 4-methylphenoxycarbonyl or 4-methoxyphenoxycarbonyl), a substituted or unsubstituted alkoxy group having 1 to 4 carbon atoms (for example, methoxy, ethoxy, n-butoxy or methoxyethoxy), a substituted or unsubstituted aryloxy group having 6 to 10 carbon atoms (for example, phenoxy or 4-methoxyphenoxy), a substituted or unsubstituted acyloxy group having 2 to 8 carbon atoms (for example, acetoxy, ethylcarbonyloxy, cyclohexylcarbonyloxy, benzoyloxy or chloroacetyloxy), a substituted or unsubstituted sulfonyloxy group having 1 to 6 carbon atoms (for example, methanesulfonyloxy), a carbamoyloxy group having 2 to 8 carbon atoms (for example, methylcarbamoyloxy or diethylcarbamoyloxy), a substituted or unsubstituted amino group having 0 to 8 carbon atoms (for example, unsubstituted amino, methylamino, dimethylamino, diethylamino, phenylamino, methoxyphenylamino, chlorophenylamino, morpholino, piperidino, pyrrolidino, pyridylamino, methoxycarbonylamino, n-butoxycarbonylamino, phenoxycarbonylamino, methylcarbamoylamino, phenylcarbamoylamino, acetylamino, ethylcarbonylamino, cyclohexylcarbonylamino, benzoylamino, chloroacetylamino or methylsulfonylamino), a substituted or unsubstituted carbamoyl group having 1 to 8 carbon atoms (for example, unsubstituted carbamoyl, methylcarbamoyl, ethylcarbamoyl, n-butylcarbamoyl, t-butylcarbamoyl, dimethylcarbamoyl, morpholinocarbamoyl or pyrrolidinocarbamoyl), a substituted or unsubstituted sulfonamido group having 1 to 8 carbon atoms (for example, methanesulfonamido or p-toluenesulfonamido), a halogen atom (for example, fluorine, chlorine or bromine), a hydroxyl group, a nitro group, a cyano group or a carboxyl group.

$R^1$ is preferably a hydrogen atom or a substituent selected from an alkyl group, an aryl group, an alkoxycarbonyl group and an aryloxycarbonyl group, more preferably a hydrogen atom. m is preferably 0, 1 or 2. When m=1 or 2, $R^2$ is preferably a substituent selected from an alkyl group, an aryl group, an amino group, an alkoxy group, an acyloxy group, a carbamoyl group, a halogen atom, a nitro group and a carboxyl group.

Most preferably, m=0.

$R^3$ is preferably a hydrogen atom or a substituent selected from an alkyl group and an aryl group, more preferably an alkyl group.

A preferred combination is realized when the acid nucleus represented by A is 5-pyrazolone, hydroxypyridone, pyrazolopyridone, barbituric acid or isoxazolone, n=0, m=0, $R^1$ is a hydrogen atom, $R^3$ is a hydrogen atom or an alkyl group and X is an alkoxycarbonyl group or a cyano group.

A more preferred combination is realized when the acid nucleus represented by A is 5-pyrazolone, n=0, m=0, $R^1$ is a hydrogen atom, $R^3$ is an alkyl group and X is an alkoxycarbonyl group.

A' of the general formula (Va) represents a residue of the acid nucleus represented by A.

The position at which the phenyl group is substituted with the carboxyl group is not limited.

k is 1, 2 or 3, preferably 1 or 2, and most preferably 1.

With respect to the general formula (Va), a preferred combination is realized when A' is a 5-pyrazolone residue, a hydroxypyridone residue, a pyrazolopyridone residue, a barbituric acid residue or an isoxazolone residue, k=1 or 2, $R^1$ is a hydrogen atom, a methyl group or a phenyl group, $R^3$ is a hydrogen atom or an alkyl group and X is an alkoxycarbonyl group or a cyano group. Further, when n=0 and when m=0, in combination with the above mentioned preferred combination, are preferred.

Most preferred combination is realized when A' is a 5-pyrazolone residue, n=0, m=0, k=1, $R^1$ is a hydrogen atom, $R^3$ is an alkyl group and X is an alkoxycarbonyl group.

The substituents represented by $R^4$ and $R^5$ of the general formula (Vb) are the same as those represented by $R^1$, $R^2$ and $R^3$.

Provided, however, that $R^4$ or $R^5$ has at least one carboxyl group.

The substituent represented by $R^4$ is preferably an unsubstituted alkyl group or a substituted or unsubstituted amino group, more preferably an unsubstituted alkyl group or an unsubstituted amino group, and most preferably a methyl group or an unsubstituted amino group.

The substituent represented by $R^5$ is preferably an aryl group substituted with a carboxyl group, more preferably a carboxyphenyl group.

With respect to the general formula (Vb), a preferred combination is realized when m=0, $R^1$ is a hydrogen atom, $R^3$ is a hydrogen atom or an alkyl group, $R^4$ is an unsubstituted alkyl group or a substituted or unsubstituted amino group, $R^5$ is an aryl group substituted with a carboxyl group and X is an alkoxycarbonyl group or a cyano group.

A more preferred combination is realized when m=0, $R^1$ is a hydrogen atom, $R^3$ is an alkyl group, $R^4$ is a methyl group or an unsubstituted amino group, $R^5$ is a carboxyphenyl group and X is an alkoxycarbonyl group.

The yellow dye for use in the present invention is sparingly soluble in a water of 5 to 7 pH. The terminology "sparingly soluble in water" used herein refers to a compound whose solubility in a water of 5 to 7 pH is not greater than 1.0 g/L (25° C.).

For ensuring the sparing solubility in water, the yellow dye for use in the present invention should not have a substituent such as, especially, a sulfo group or a salt (for example, a sodium salt, a potassium salt or an ammonium salt) thereof.

Specific examples of the yellow dyes suitable for the present invention will be set forth below, which in no way limit the scope of the present invention.

V-1
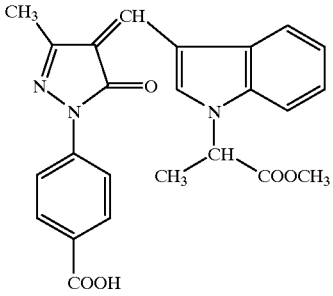
V-2
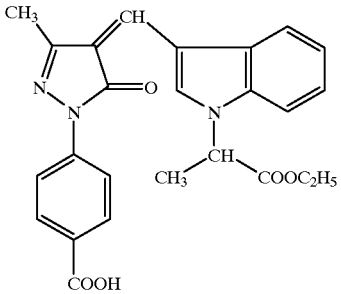
V-3
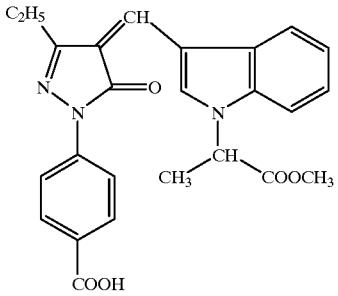
V-4
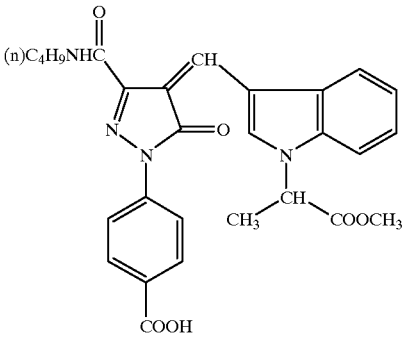
V-5
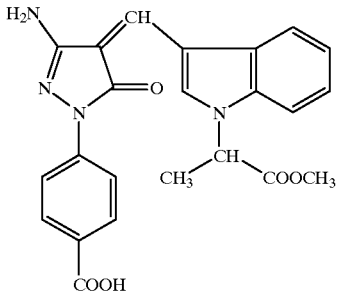
-continued
V-6
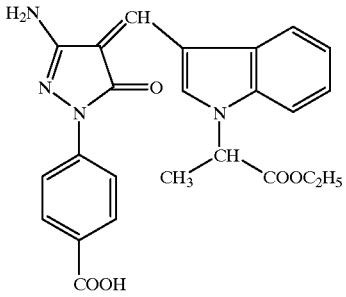
V-7
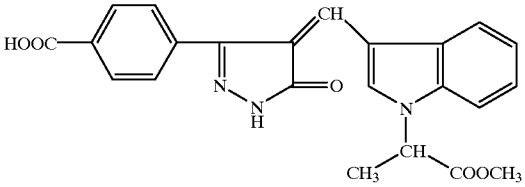
V-8
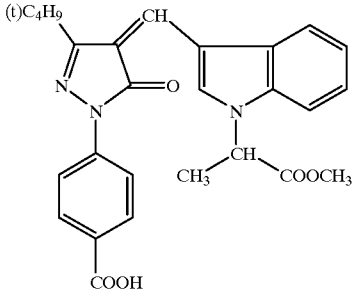
V-9
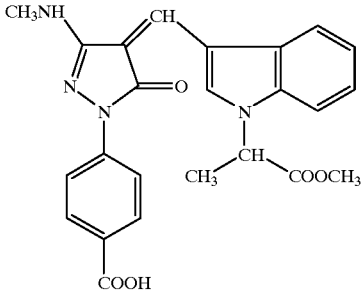
V-10
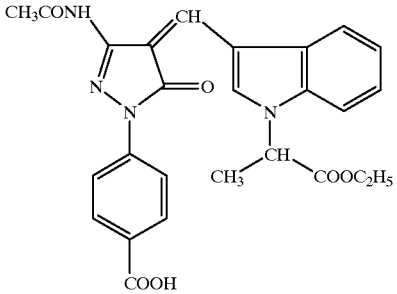

-continued
V-11
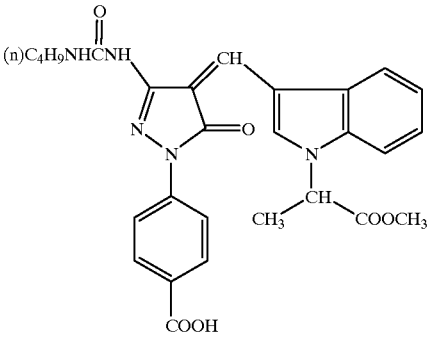
V-12
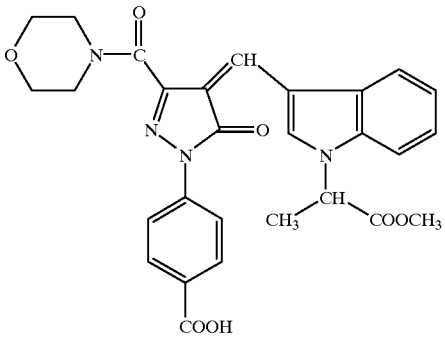
V-13
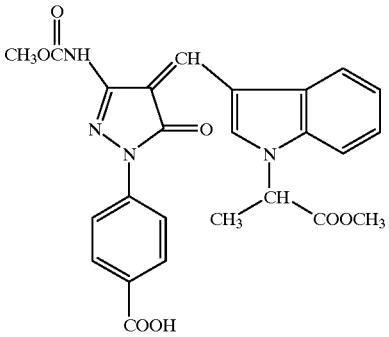
V-14
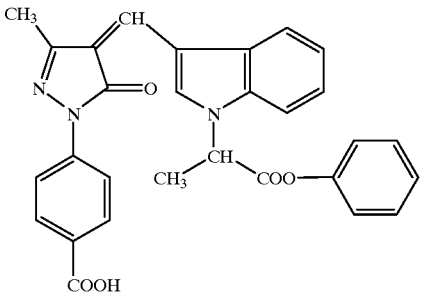
V-15
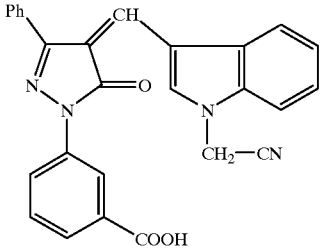
-continued
V-16
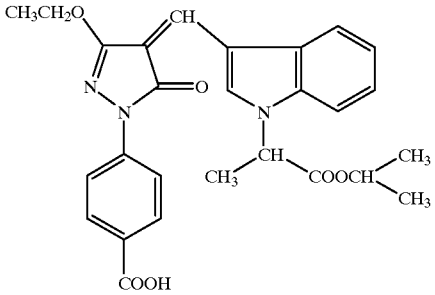
V-17
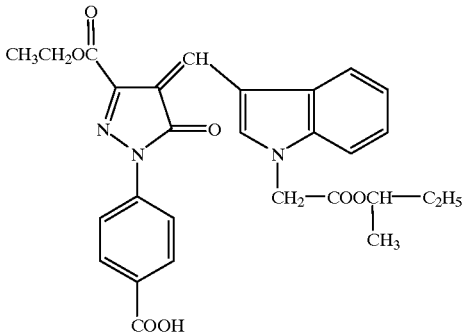
V-18
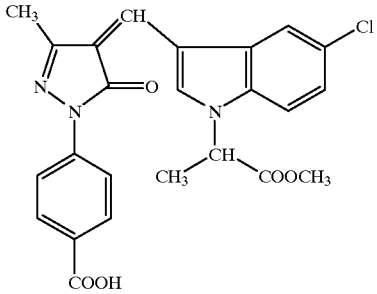
V-19
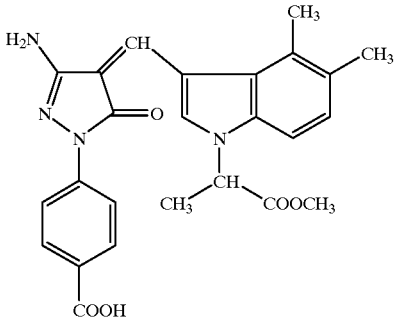
V-20
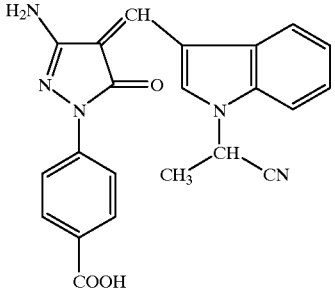

-continued
V-21
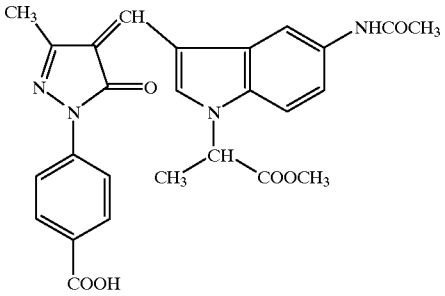
V-22
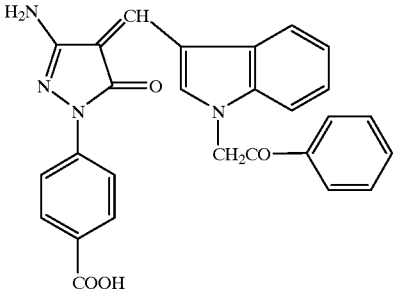
V-23
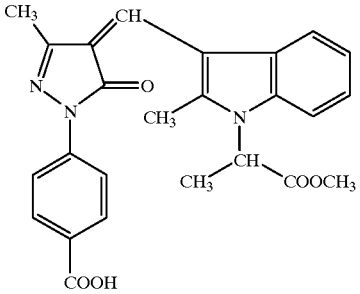
V-24
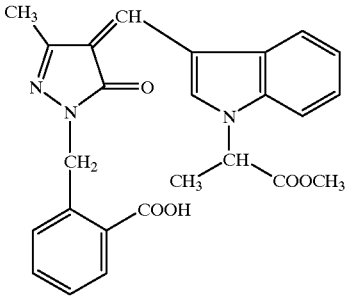
V-25
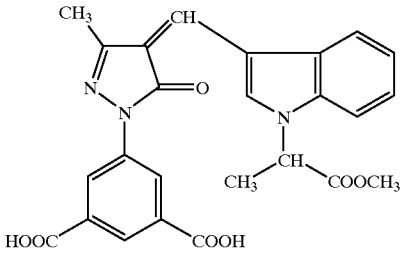
-continued
V-26
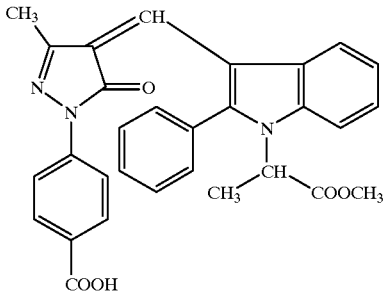
V-27
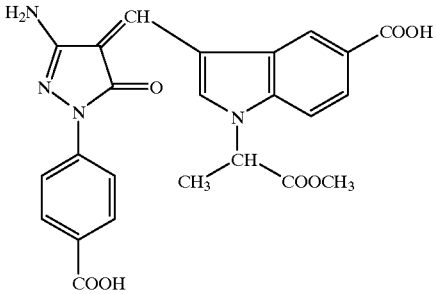
V-28
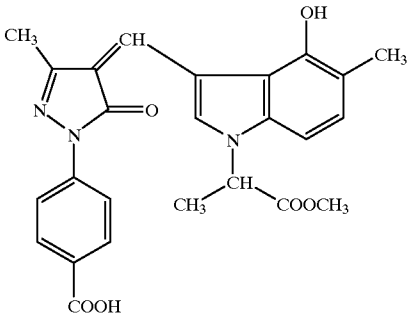
V-29
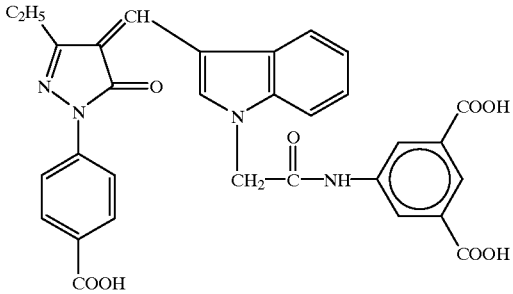
V-30
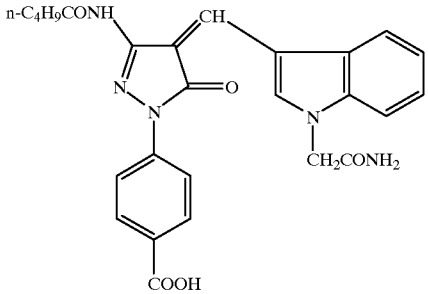

-continued
V-31
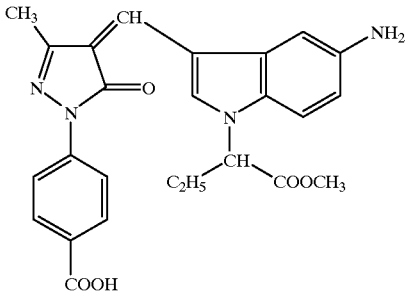
V-32
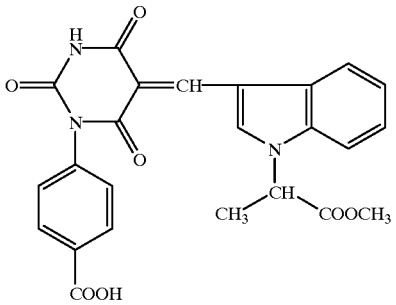
V-33
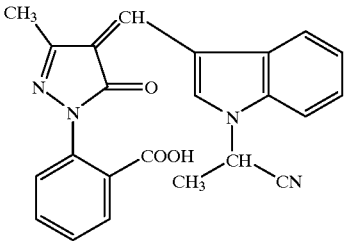
V-34
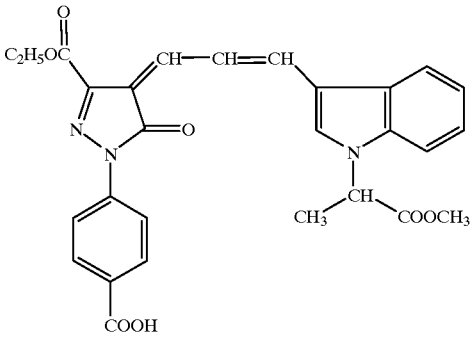
V-35
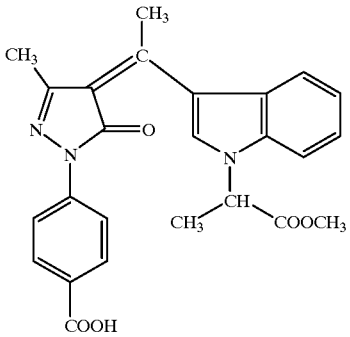
-continued
V-36
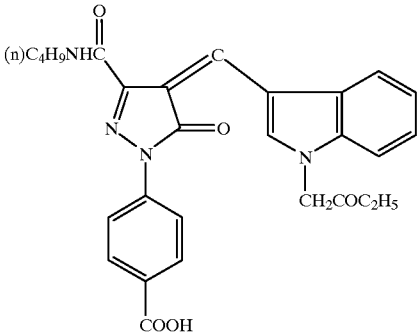
V-37
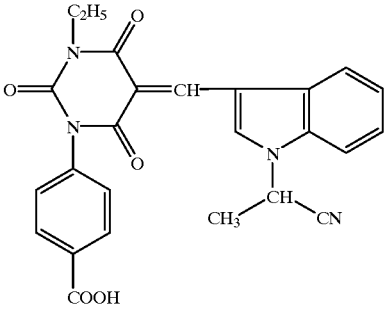
V-38
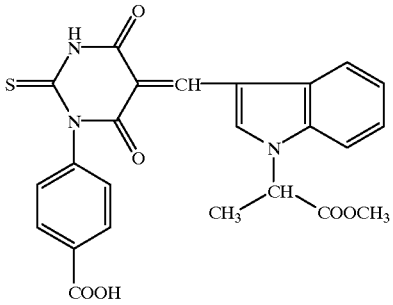
V-39
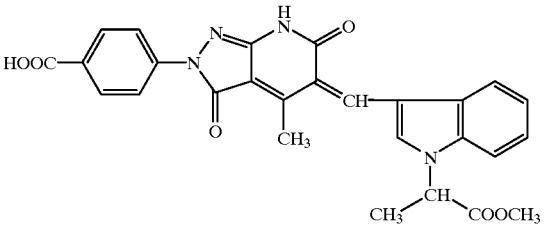
V-40
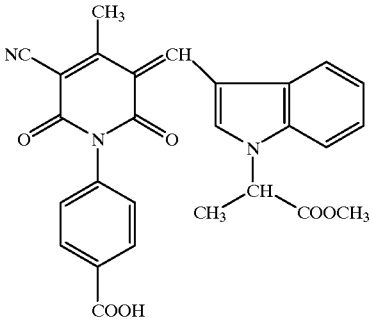

-continued
V-41
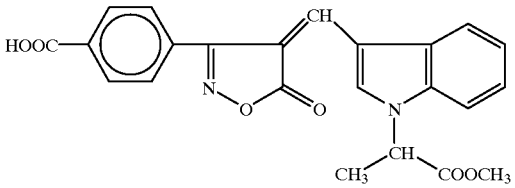
V-42
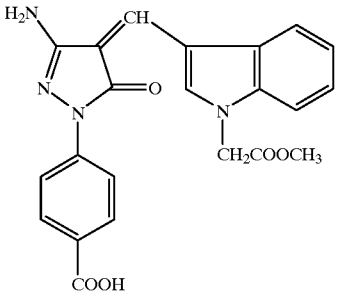
V-43
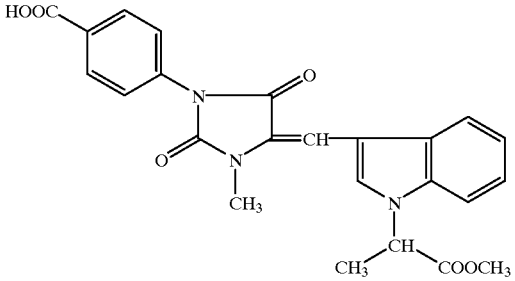
V-44
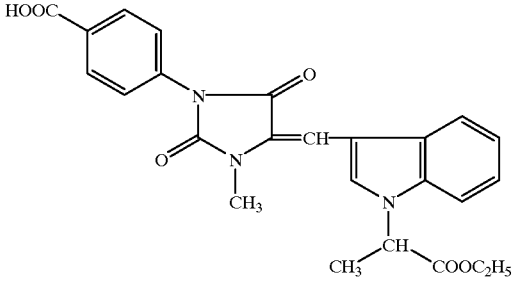
-continued
V-45
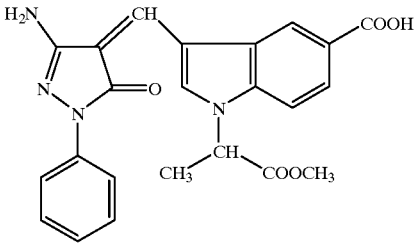
V-46
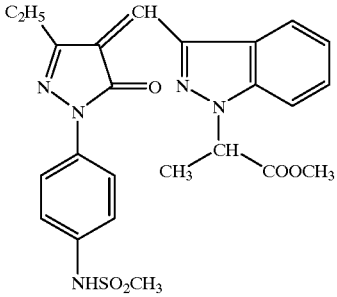
V-47
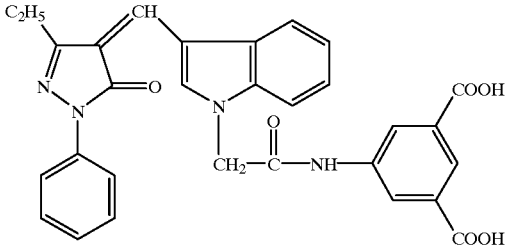
V-48
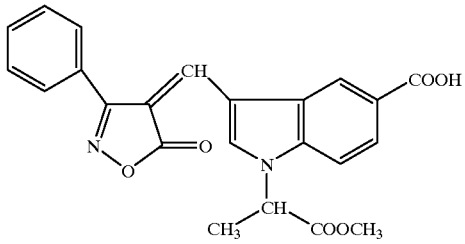
V-49
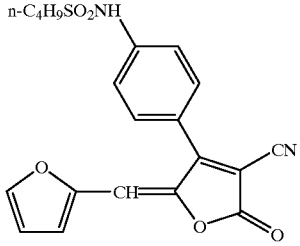

In the present invention, the dispersion of the dye, as described in JP-A-52-92716 and PCT International Publication No. 88/04794, can be performed by the use of dispersers such as a ball mill, a sand mill and a colloid mill and, further, dispersers such as a vibrating ball mill, a planetary ball mill, a jet mill, a roll mill, Mantongaulin, a microfluidizer and a disk impeller mill, which can arbitrarily be selected. Vertical or horizontal medium dispersers are preferred.

Irrespective of the type of disperser, it is preferred to use a solvent (e.g., water). It is more preferred to use further a dispersion surfactant. Anionic surfactants as described in, for example, JP-A-52-92716 and PCT International Publication No. 88/14794 and anionic polymers as described in, for example, JP-A-4-324858 can be used as the dispersion surfactant. If necessary, use can be made of nonionic or cationic surfactants. Anionic polymers and anionic surfactants are preferred.

Microcrystals of the dye for use in the present invention may be precipitated by dissolving the dye in an appropriate solvent and thereafter adding a poor solvent for the dye to the solution. In this instance as well, use may be made of the above dispersion surfactant. Alternatively, microcrystals of the dye may be obtained by controlling the pH in a solvent to thereby effect a dissolution and thereafter changing the pH.

In the dispersion, the dye for use in the present invention has an average grain diameter of 0.005 to 10 $\mu$m, preferably 0.01 to 1 $\mu$m, and more preferably 0.01 to 0.5 $\mu$m. Occasionally, it is most preferred that the average grain size range from 0.01 to 0.1 $\mu$m. Further, fine grains of the dye are preferably in monodispersed form.

In the dispersion of the dye of the general formula (V), a dye solid may be directly dispersed without any pretreatment thereto. It is preferred that the dye solid in wet form obtained during the synthesis of the dye be subjected to dispersion.

If necessary, the dye may be heated prior to dispersion and/or after dispersion. From the viewpoint of effective heating treatment, it is preferred that heating be effected at least after dispersion.

The heating method is not particularly limited as long as heat is applied to the dye solid. The temperature is preferably at least 40° C., and the upper limit thereof is not limited as long as the dye is not decomposed. The temperature is, however, preferably up to 250° C. More preferably, the temperature ranges from 50 to 150° C.

The heating period, although not particularly limited as long as the dye is not decomposed, is generally in the range of 15 min to 1 week, preferably 1 hr to 4 days.

For ensuring effective heating treatment, the dye is preferably heated in a solvent. The type of solvent is not limited as long as the dye of the general formula (V) is substantially not dissolved therein. For example, the solvent can be any of water, alcohols (for example, methanol, ethanol, isopropyl alcohol, butanol, isoamyl alcohol, octanol, ethylene glycol, diethylene glycol and ethyl cellosolve), ketones (for example, acetone and methyl ethyl ketone), esters (for example, ethyl acetate and butyl acetate), alkylcarboxylic acids (for example, acetic acid and propionic acid), nitrites (for example, acetonitrile) and ethers (for example, dimethoxyethane, dioxane and tetrahydrofuran).

The presence of an organic carboxylic acid at heating enables effectively attaining the advantages of the present invention. Examples of the organic carboxylic acid include alkylcarboxylic acids (for example, acetic acid and propionic acid), carboxymethylcelluloses (CMC) and arylcarboxylic acids (for example, benzoic acid and salicylic acid).

The organic carboxylic acid, when employed as a solvent, can be used in an amount of 0.5 to 100 times the weight of the dye of the general formula (V). When use is made of a solvent other than the organic carboxylic acids and the organic carboxylic acid is added thereto, the use amount thereof can be 0.05 to 100% by weight based on the dye of the general formula (V).

The addition amount of the dye represented by the general formula (V) is in the range of 0.15 to 1.0 g/m$^2$, preferably 0.18 to 0.6 g/m$^2$, and more preferably 0.2 to 0.3 g/m$^2$. The addition may be conducted at any stage prior to the coating.

The dye represented by the general formula (V) can be used in any of the emulsion layers and other hydrophilic colloid layers (interlayer, protective layer, antihalation layer, filter layer, back layer, etc.). The dye may be used in either a single layer or a plurality of layers.

In the present invention, although it is requisite that each color-sensitive emulsion layer unit comprise at least two emulsion sub-layers of different speeds, the unit preferably comprises at least three color-sensitive emulsion sub-layers, more preferably all the color-sensitive emulsion layer units comprises at least three emulsion sub-layers, all of which have speeds different from each other.

It is preferred that, the closer to support side a color-sensitive emulsion layer unit, the greater the weight ratio of silver/binder of the lowest-speed emulsion layer of the color-sensitive emulsion layer unit.

With respect to the various techniques and organic and inorganic materials which can be employed in the silver halide photographic material of the present invention and the silver halide photographic emulsion contained therein, use can generally be made of those described in Research Disclosure Nos. 308119 (1989), 37038 (1995) and 40145 (1997), all the disclosures of which are herein incorporated by reference.

In addition, more specifically, for example, techniques and organic and inorganic materials which can be used in the color photographic lightsensitive material of the invention and the silver halide photographic emulsion contained therein are described in the following portions of EP 436, 938A2 and the patents cited below, all the disclosures of which are herein incorporated by reference.

Item: Appropriate portion

1. Layer arrangement:

page 146, line 34 to page 147, line 25

2. Silver halide emulsion:

page 147, line 26 to page 148 to line 12

3. Yellow coupler:

page 137, line 35 to page 146, line 33 and page 149, lines 21 to 23

4. Magenta coupler:

page 149, lines 24 to 28; EP 421,453A1, page 3, line 5 to page 25, line 55

5. Cyan coupler:

page 149, lines 29 to 33; EP 432,804A2, page 3, line 28 to page 40, line 2

6. Polymer coupler:

page 149, lines 34 to 38; EP 435,334A2, page 113, line 39 to page 123, line 37

7. Colored coupler:

page 53, line 42 to page 137, line 34 and page 149, lines 39 to 45

8. Other functional couplers:

page 7, line 1 to page 53, line 41 and page 149, line 46 to page 150, line 3; EP 435,334A2, page 3, line 1 to page 29, line 50

9. Antiseptic and mildewproofing agents:

page 150, lines 25 to 28

10. Formalin scavenger:

page 149, lines 15 to 17

11. Other additives usable in combination:

page 153, lines 38 to 47; EP 421,453A1, page 75, line 21 to page 84, line 56 and page 27, line 40 to page 37, line 40

12. Dispersion method:

page 150, lines 4 to 24

13. Support:

page 150, lines 32 to 34

14. Thickness/properties of film:

page 150, lines 35 to 49

15. Color development step:

page 150, line 50 to page 151, line 47

16. Desilvering step:

page 151, line 48 to page 152, line 53

17. Automatic processor:

page 152, line 54 to page 153, line 2

18. Washing with water/stabilization step:

page 153, lines 3 to 37.

EXAMPLE

The present invention will be described in greater detail below by way of its examples, which in no way limit the scope of the present invention.

Example 1

Preparation of sample 101

A multilayered color lightsensitive material comprising a support of 127 $\mu$m-thick undercoated cellulose triacetate film and, superimposed thereon, layers of the following compositions was prepared and designated sample 101. The figure indicates the addition amount per $m^2$. The effects of added compounds are not limited to described use.

| | |
|---|---|
| 1st layer: antihalation layer | |
| Black colloidal silver | 0.28 g |
| Gelatin | 2.20 g |
| Ultraviolet absorber U-1 | 0.27 g |
| Ultraviolet absorber U-3 | 0.08 g |
| Ultraviolet absorber U-4 | 0.08 g |
| High b.p. org. solvent Oil-1 | 0.29 g |
| Dye D-3 | 10.0 mg |
| Dye D-5 | 0.12 mg |
| 2nd layer: interlayer | |
| Gelatin | 0.38 g |
| Compound Cpd-H | 3.5 mg |
| Ultraviolet absorber U-2 | 3.0 mg |
| Compound Cpd-J | 1.0 mg |
| High b.p. org; solvent Oil-5 | 2.0 mg |
| High b.p. org. solvent Oil-4 | 0.06 g |
| Dye D-1 | 0.01 g |
| Dye D-2 | 0.01 g |
| Dye D-4 | 0.01 g |
| 3rd layer: interlayer | |
| Yellow colloidal silver | Ag qty. 0.007 g |
| Gelatin | 0.40 g |
| 4th layer: low-speed red-sensitive emulsion layer | |
| Emulsion A | Ag qty. 0.27 g |
| Emulsion B | Ag qty. 0.23 g |
| Emulsion C | Ag qty. 0.23 g |

-continued

| | |
|---|---|
| Gelatin | 0.85 g |
| Coupler C-1 | 0.04 g |
| Coupler C-2 | 0.09 g |
| High b.p. org. solvent Oil-2 | 0.09 g |
| 5th layer: medium-speed red-sensitive emulsion layer | |
| Emulsion D | Ag qty. 0.43 g |
| Gelatin | 0.65 g |
| Coupler C-1 | 0.05 g |
| Coupler C-2 | 0.11 g |
| High b.p. org. solvent Oil-2 | 0.09 g |
| 6th layer: high-speed red-sensitive emulsion layer | |
| Emulsion E | Ag qty. 0.50 g |
| Gelatin | 1.56 g |
| Coupler C-3 | 0.63 g |
| Additive P-1 | 0.16 g |
| High b.p. org. solvent Oil-2 | 0.04 g |
| 7th layer: interlayer | |
| Gelatin | 0.50 g |
| Compound Cpd-D | 0.02 g |
| Compound Cpd-J | 0.02 g |
| High b.p. org. solvent Oil-3 | 0.04 g |
| High b.p. org. solvent Oil-5 | 0.04 g |
| 8th layer: interlayer | |
| Yellow colloidal silver | Ag qty. 0.01 g |
| Gelatin | 0.90 g |
| Compound Cpd-J | 0.07 g |
| High b.p. org. solvent Oil-5 | 0.15 g |
| 9th layer: low-speed green-sensitive emulsion layer | |
| Emulsion F | Ag qty. 0.42 g |
| Emulsion G | Ag qty. 0.38 g |
| Emulsion H | Ag qty. 0.32 g |
| Gelatin | 1.53 g |
| Coupler C-7 | 0.07 g |
| Coupler C-8 | 0.17 g |
| Compound Cpd-B | 0.30 mg |
| Compound Cpd-C | 2.00 mg |
| Compound Cpd-H | 3.50 mg |
| Polymer latex P-2 | 0.02 g |
| High b.p. org. solvent Oil-2 | 0.10 g |
| 10th layer: medium-speed green-sensitive emulsion layer | |
| Emulsion I | Ag qty. 0.16 g |
| Emulsion J | Ag qty. 0.34 g |
| Gelatin | 0.57 g |
| Coupler C-4 | 0.20 g |
| Compound Cpd-B | 0.03 g |
| Polymer latex P-2 | 0.01 g |
| High b.p. org. solvent Oil-2 | 0.01 g |
| 11th layer: high-speed green-sensitive emulsion layer | |
| Emulsion K | Ag qty. 0.44 g |
| Gelatin | 0.69 g |
| Coupler C-4 | 0.34 g |
| Compound Cpd-B | 0.06 g |
| Polymer latex P-2 | 0.01 g |
| High b.p. org. solvent Oil-2 | 0.02 g |
| 12th layer: yellow filter layer | |
| Yellow colloidal silver | Ag qty. 0.002 g |
| Gelatin | 0.73 g |
| Microcrystalline dispersion of dye E-1 | 0.24 g |
| Compound Cpd-J | 0.06 g |
| High b.p. org. solvent Oil-5 | 0.09 g |
| Polymer M-1 | 0.23 g |

-continued

| | |
|---|---|
| 13th layer: low-speed blue-sensitive emulsion layer | |
| Emulsion L | Ag qty. 0.15 g |
| Emulsion M | Ag qty. 0.05 g |
| Emulsion N | Ag qty. 0.15 g |
| Gelatin | 0.55 g |
| Coupler C-5 | 0.20 g |
| Coupler C-6 | 4.00 g |
| Coupler C-9 | 0.02 g |
| Compound Cpd-E | 0.07 g |
| 14th layer: medium-speed blue-sensitive emulsion layer | |
| Emulsion O | Ag qty. 0.06 g |
| Emulsion P | Ag qty. 0.10 g |
| Gelatin | 0.75 g |
| Coupler C-5 | 0.35 g |
| Coupler C-6 | 5.00 g |
| Coupler C-9 | 0.30 g |
| Compound Cpd-E | 0.02 g |
| Compound Cpd-I | 0.02 g |
| 15th layer: high-speed blue-sensitive emulsion layer | |
| Emulsion Q | Ag qty. 0.20 g |
| Emulsion R | Ag qty. 0.02 g |
| Gelatin | 2.40 g |
| Coupler C-6 | 0.09 g |
| Coupler C-9 | 0.90 g |
| Compound Cpd-E | 0.04 g |
| Compound Cpd-I | 0.05 g |
| Compound Cpd-K | 0.05 mg |
| High b.p. org. solvent Oil-2 | 0.40 g |
| Additive P-2 | 0.10 g |
| 16th layer: 1st protective layer | |
| Gelatin | 1.00 g |
| Ultraviolet absorber U-1 | 0.10 g |
| Ultraviolet absorber U-2 | 0.03 g |
| Ultraviolet absorber U-5 | 0.20 g |
| Compound Cpd-F | 0.40 g |

-continued

| | |
|---|---|
| Compound Cpd-J | 0.06 g |
| High b.p. org. solvent Oil-3 | 0.30 g |
| 17th layer: 2nd protective layer | |
| Fine grain silver iodobromide emulsion (av. equiv. spherical diam. 0.06 μm, AgI cont. 1 mol %) | Ag qty. 0.10 g |
| Gelatin | 0.70 g |
| Ultraviolet absorber U-1 | 0.06 g |
| Ultraviolet absorber U-2 | 0.02 g |
| Ultraviolet absorber U-5 | 0.12 g |
| High b.p. org. solvent Oil-1 | 0.07 g |
| Compound Cpd-L | 0.80 mg |
| 18th layer: 3rd protective layer | |
| Gelatin | 1.40 g |
| Polymer latex P-3 (av. grain size 0.07 μm) | 0.20 g |
| Matting agent P-4 (av. grain size 1.5 μm) | 5.00 g |
| Matting agent P-5 (av. grain size 1.5 μm) | 0.10 g |
| Silicone oil SO-1 | 0.030 g |
| Surfactant W-2 | 0.005 g |
| Surfactant W-1 | 0.020 g |

The above layers were doped with additives F-1 to F-7 and F-10 to F-11 and Cpd-A and Cpd-G in addition to the above components. Furthermore, the layers were doped with gelatin hardener H-1 and surfactants for emulsification and coating W-3, W-4, W-5 and W-6 in addition to the above components.

Moreover, phenol, 1,2-benzisothiazolin-3-one, 2-phenoxyethanol, phenethyl alcohol and butyl phydroxybenzoate were added thereto as antiseptic and mildewproofing agents.

The lightsensitive emulsions employed in sample 101 are specified in Table 1.

TABLE 1

| Emulsion | Equivalent spherical diameter (μm) | Variation coefficient of equivalent circular diameter (%) | All-grain average aspect ratio | Iodine content (mol. ratio) |
|---|---|---|---|---|
| A | 0.18 | 8 | 1.0 | 3.5 |
| B | 0.22 | 15 | 2.0 | 3.5 |
| C | 0.28 | 14 | 2.5 | 3.5 |
| D | 0.35 | 10 | 3.6 | 4.8 |
| E | 0.43 | 16 | 5.0 | 1.5 |
| F | 0.15 | 7 | 1.0 | 3.5 |
| G | 0.19 | 8 | 1.0 | 3.5 |
| H | 0.29 | 11 | 2.4 | 3.5 |
| I | 0.28 | 11 | 4.5 | 3.3 |
| J | 0.40 | 16 | 4.0 | 3.3 |
| K | 0.59 | 20 | 5.9 | 2.8 |
| L | 0.24 | 9 | 1.0 | 4.6 |
| M | 0.24 | 10 | 1.0 | 4.6 |
| N | 0.31 | 13 | 3.0 | 4.6 |
| O | 0.30 | 10 | 3.0 | 4.6 |
| P | 0.40 | 9 | 4.5 | 4.6 |
| Q | 0.7 | 15 | 5.5 | 1.0 |
| R | 0.86 | 18 | 25 | 1.0 |

| | Sensitizing dye | | Sensitizing dye | | Sensitizing dye | | Compound F-8 |
|---|---|---|---|---|---|---|---|
| Emulsion | Type | Additive amount (× $10^{-4}$ mol/mol Ag) | Type | Additive amount (× $10^{-4}$ mol/mol Ag) | Type | Additive amount (× $10^{-4}$ mol/mol Ag) | Additive amount (× $10^{-4}$ mol/mol Ag) |
| A | S-1 | 8.1 | S-2 | 0.3 | S-3 | 0.3 | 2.6 |
| B | S-1 | 8.9 | S-2 | 0.3 | S-3 | 0.3 | 2.2 |
| C | S-1 | 8.8 | S-2 | 0.2 | S-3 | 0.2 | 2.0 |
| D | S-1 | 7.5 | S-2 | 0.3 | S-3 | 0.2 | |
| E | S-1 | 6.7 | S-2 | 0.2 | S-3 | 0.2 | |

TABLE 1-continued

| | | | | | |
|---|---|---|---|---|---|
| F | S-4 | 15.1 | S-5 | 1.5 | 2.5 |
| G | S-4 | 10.4 | S-5 | 2.0 | 2.0 |
| H | S-4 | 7.5 | S-5 | 1.4 | 1.5 |
| I | S-4 | 7.7 | S-5 | 1.4 | 1.6 |
| J | S-4 | 7.2 | S-5 | 1.4 | |
| K | S-4 | 6.4 | S-5 | 1.2 | |
| L | S-6 | 6.5 | S-7 | 2.5 | 2.1 |
| M | S-6 | 6.4 | S-7 | 2.4 | 2.1 |
| N | S-6 | 6.3 | S-7 | 2.0 | 1.8 |
| O | S-6 | 6.2 | S-7 | 2.0 | 1.7 |
| P | S-6 | 5.6 | S-7 | 1.8 | |
| Q | S-6 | 4 | S-7 | 1.5 | |
| R | S-6 | 3.4 | S-7 | 1.1 | |

1) All the above emulsions were chemically sensitized with gold-, sulfur- and selenium-sensitizers.

Note 2) All the above emulsions were doped with sensitizing dyes before chemical sensitization.

Note 3) All the above emulsions were appropriately doped with compounds F-9, F-10, F-11, F-12, F-13, F-14 and F-15.

Note 4) Emulsions A, B, F and G are tabular grains of treble structure whose principal planes are (100) while the other emulsions are tabular grains of treble structure whose principal planes are (111).

Note 5) Emulsions A, B, E, F, I and P have internal speeds higher than surface speeds.

Note 6) In emulsions E, I and P, epitaxial growth of silver chloride was effected after chemical sensitization.

Note 7) Emulsions other than emulsions A, E and F comprise grains having at least 50 dislocation lines per grain observable through a transmission electron microscope.

Note 8) Compound F-8 was added at 50 to 70° C. before chemical sensitization without exception.

(Preparation of dispersion of organic solid dispersed dye)

Dye E-1 (same as compound example V-1) was dispersed by the following method. Specifically, 70 g of W-4 and water were added to 1400 g of a wet cake of dye containing 30% of water and agitated, thereby obtaining a slurry having a dye concentration of 30%. 1700 ml of zirconia beads having an average grain diameter of 0.5 mm were charged into Ultraviscomill (UVM-2) manufactured by Aimex Co., Ltd. and the slurry was fed and milled at a peripheral speed of about 10 m/sec and a delivery rate of 0.5 lit./min for 8 hr. The beads were removed by filtration, and the slurry was heated at 90° C. for 10 hr for stabilization. Thereafter, water and gelatin were added to thereby effect a dilution to a dye concentration of 3%. The obtained dye fine grains had an average grain diameter of 0.4 $\mu$m and a grain size distribution breadth (standard deviation of grain diameter ×100/average grain size) of 18%.

C-1

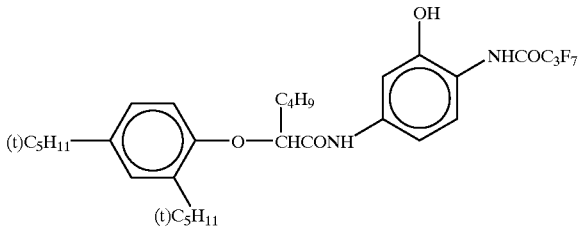

C-2

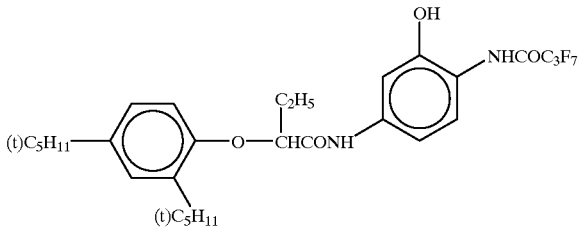

-continued
C-3
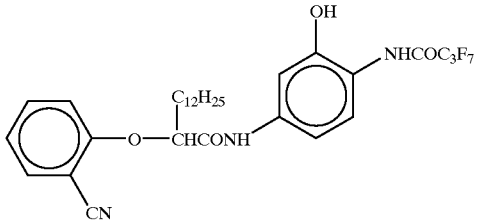
C-4
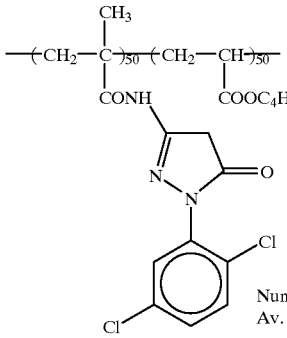
Numbers are in weight %
Av. mol. wt.: about 25,000
C-5
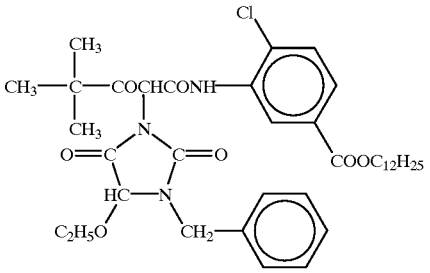
C-6
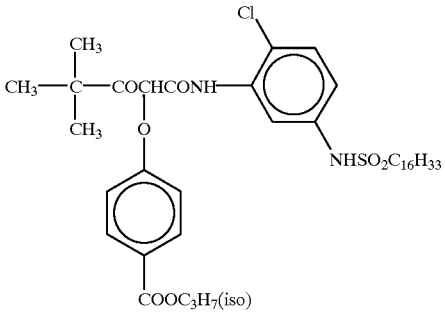
C-7
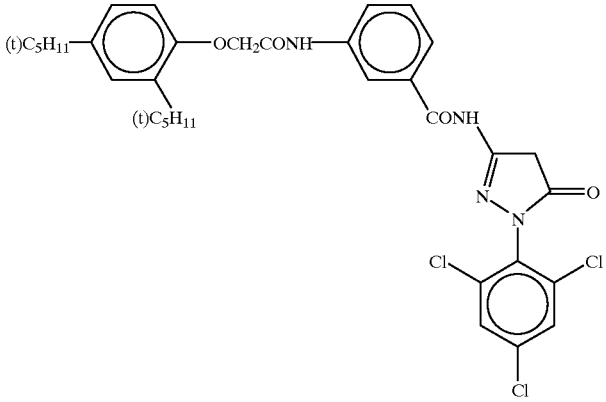
C-8
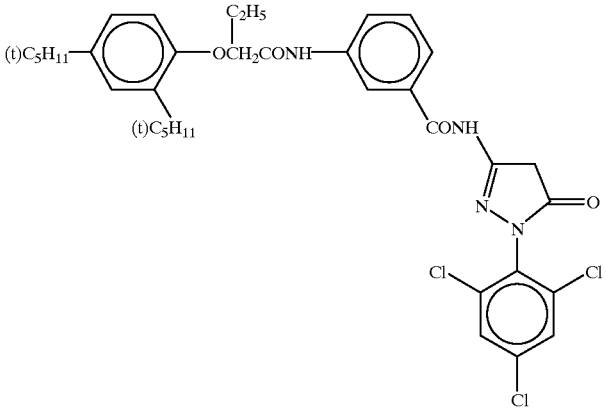

-continued
C-9
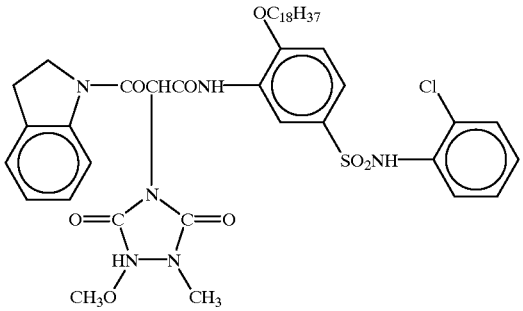
Oil-1
Dibutyl phthalate
Oil-2
Tricresyl phosphate
Oil-3
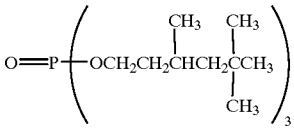
Oil-4
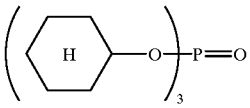
Oil-5
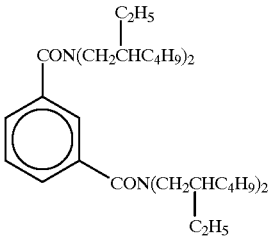
Cpd-A
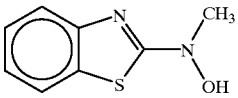
Cpd-B
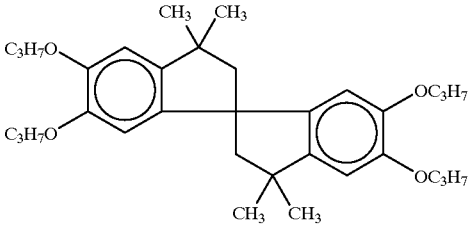
Cpd-C
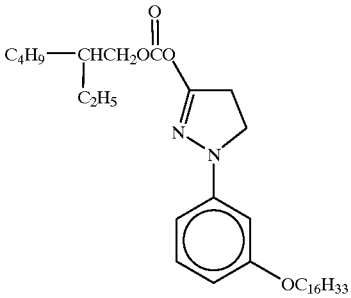
Cpd-D
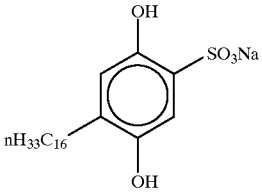
Cpd-E
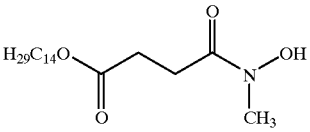
Cpd-F
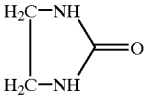
Cpd-G
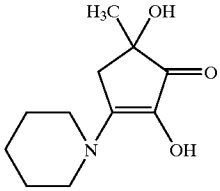

-continued
Cpd-H
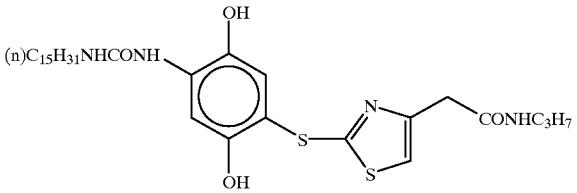
Cpd-I
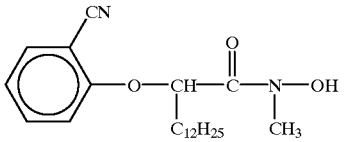
Cpd-J
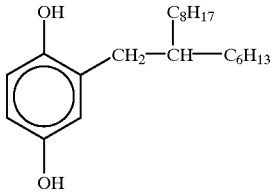
Cpd-K
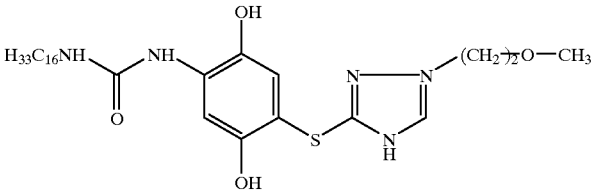
Cpd-L
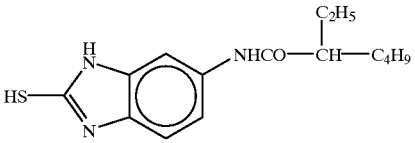
U-1
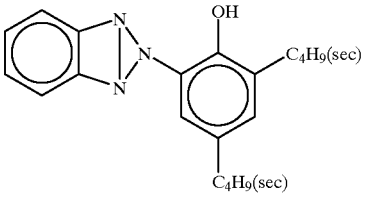
U-2
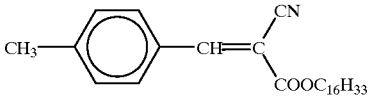
U-3
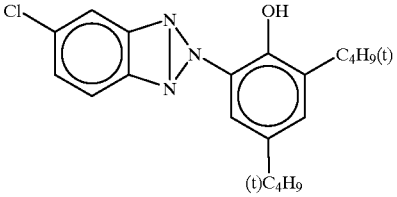
U-4
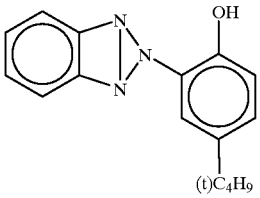
U-5
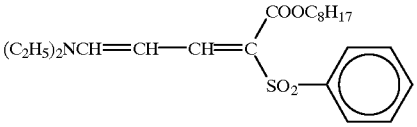
S-1
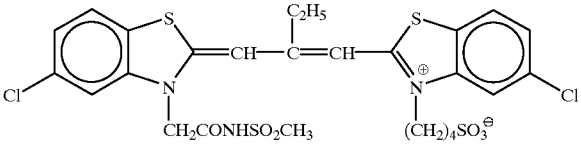
S-2
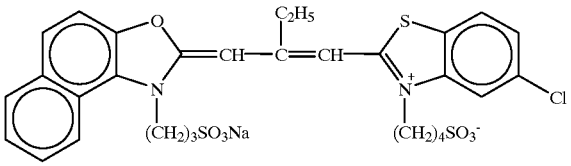

-continued
S-3
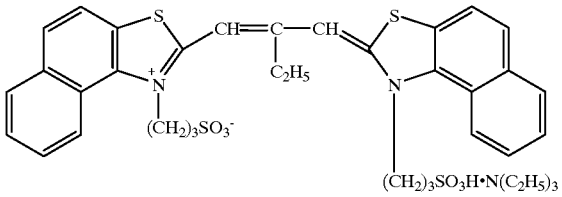
S-4
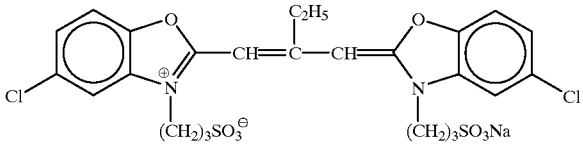
S-5
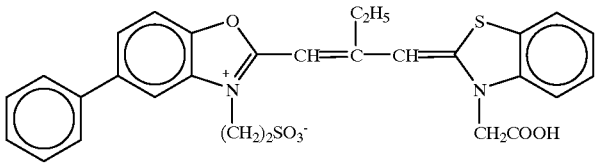
S-6
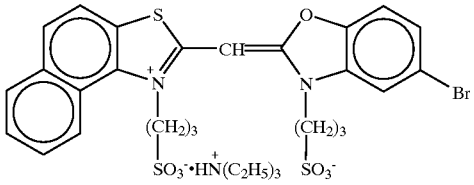
S-7
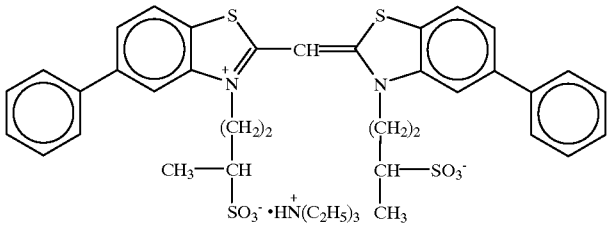
D-1
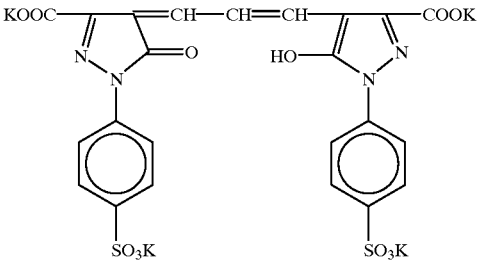
D-2
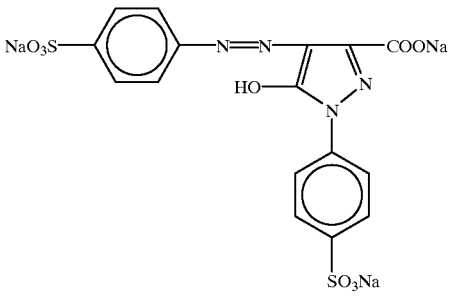

-continued
D-3
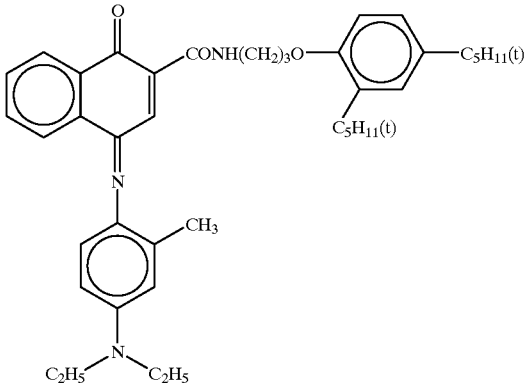
D-4
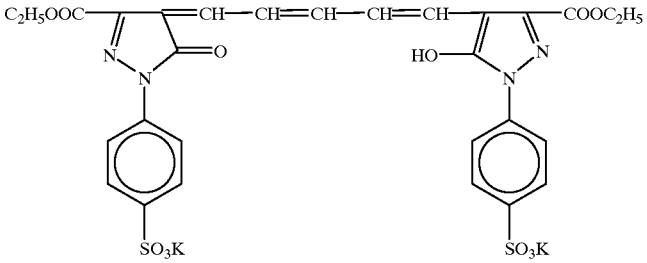
D-5
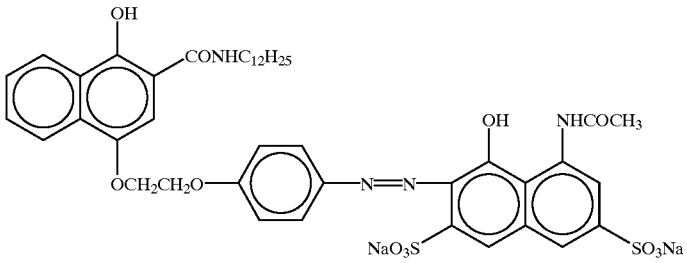
E-1
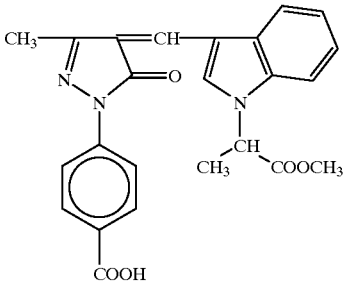
H-1
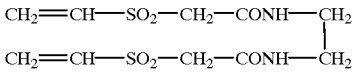
P-2
A 95:5 copolymer of polybutylacrylate/acrylic acid
P-3
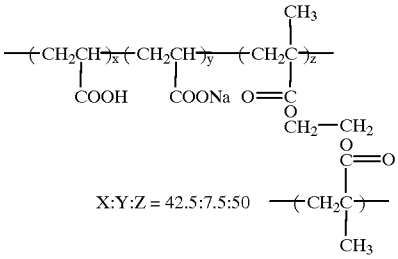

-continued
P-4
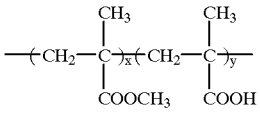
x/y = 90/10
P-5
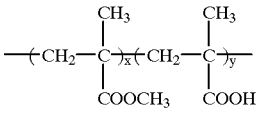
x/y = 60/40
W-1
$F_{17}C_8SO_3Li$
W-2
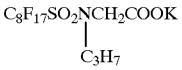
W-3
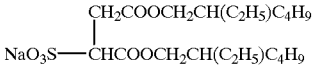
W-4
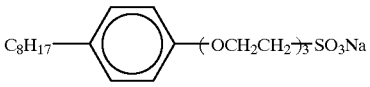
W-5
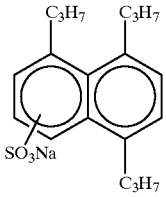
W-6
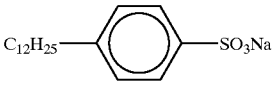
P-1
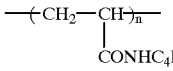
M-1
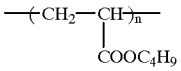
SO-1
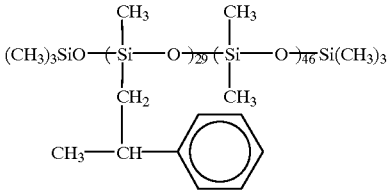
F-1
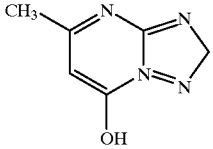
F-2
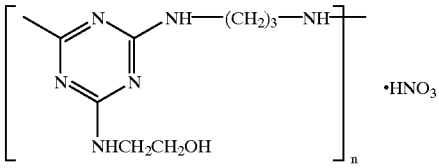
(n = 3 ~ 4)
F-3
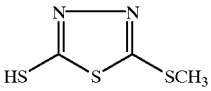
F-4
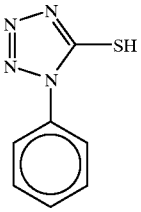
F-5
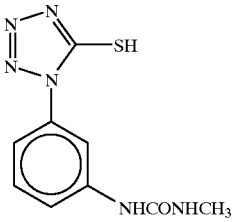
F-6
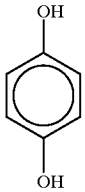
F-7
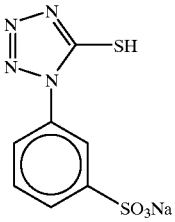

-continued

F-8

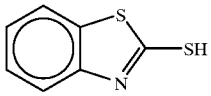

F-9

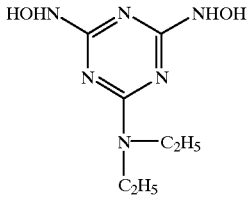

F-10

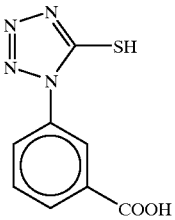

F-11

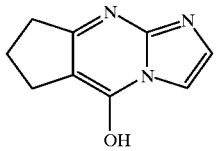

F-12

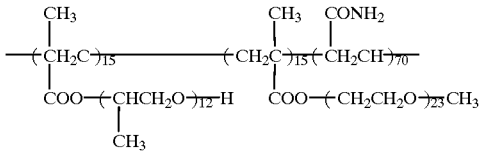

F-13

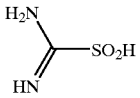

F-14

$K_2IrCl_6$

F-15

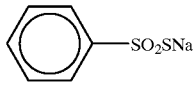

X-1

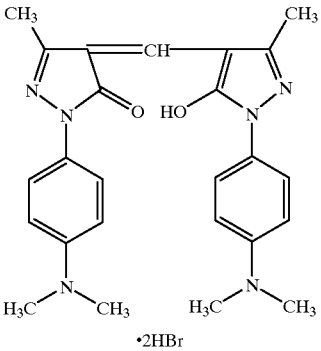

X-2

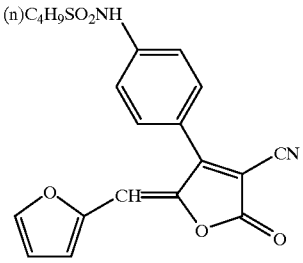

Method of Preparing Samples 102 to 106

Samples 102 to 106 were prepared in the same manner as sample 101, except that, as specified in Table 2 below, the amount of the yellow dye of the 12th layer was changed and also the amount of the yellow colloidal silver of the 12th layer was changed so as to equalize blue light absorption.

For evaluating the gradation obtained by the standard processing, one set of samples 101 to 106 were subjected to 2000 lux and 1/50 sec wedge exposure using a white light source whose color temperature was 4800 K and subjected to the processing steps for development of the standard processing in the manner as described above in the specification. Another set of samples 101 to 106 were subjected to the same procedure, except that the period of the first development was prolonged to 11 minutes, thereby performing a higher speed development processing. The point-gamma (γ) at a magenta color density of 1.0 by the standard processing, the point-gamma (γ') at a magenta color density of 1.0 by the higher speed development processing were determined to obtain the ratio (γ'/γ) and other sensitometry data. The results are listed in Table 2.

Furthermore, the excellence of image obtained by push-processing was judged by visual inspection by comparing the image obtained by photographing with ISO 100 with the use of a set of samples 101 to 106 followed by standard processing, with the image obtained by photographing with ISO 400 with the use of another set of samples 101 to 106 followed by the high speed development processing.

The evaluation was conducted according to five criteria:

5: Very good (the image is very similar to that obtained by photographing with ISO 100)

4: Good (the image is similar to that obtained by photographing with ISO 100)

3: Tolerable (the image is so-so similar to that obtained by photographing with ISO 100)

4: Poor (the image is inferior to that obtained by photographing with ISO 100)

5: Very poor (the image is very inferior to that obtained by photographing with ISO 100)

TABLE 2

| Remarks | | | Sample No. 101 Invention | 102 Invention | 103 Invention |
|---|---|---|---|---|---|
| Constitution of sample | Yellow dye in 12th layer | Compound | Solid dispersion of compound E-1 | Solid dispersion of compound E-1 | Solid dispersion of compound E-1 |
| | | Addition amount g/m$^2$ | 0.24 g | 0.36 g | 0.16 g |
| | Colloidal silver in 12th layer Addition amount of colloidal silver in 12th layer | | 0.002 g | 0 | 0.01 g |
| Sensitometry data | Point-gamma at 1st development time 6' | γ-cyan | 1.58 | 1.57 | 1.58 |
| | | γ-magenta | 1.48 | 1.44 | 1.44 |
| | | γ-yellow | 1.35 | 1.36 | 1.35 |
| | Point-gamma at 1st development time 11' | γ'-cyan | 1.78 | 1.77 | 1.78 |
| | | γ'-magenta | 1.67 | 1.65 | 1.70 |
| | | γ'-yellow | 1.50 | 1.40 | 1.55 |
| | Speed difference between 6' and 11' | | 0.55 | 0.53 | 0.57 |
| | γ'/γ | cyan | 1.13 | 1.13 | 1.13 |
| | | magenta | 1.13 | 1.15 | 1.18 |
| | | yellow | 1.11 | 1.03 | 1.15 |
| | minimum of γ'/γ (γ'/γ-min) | | 1.11 | 1.03 | 1.13 |
| | maximum of γ'/γ (γ'/γ-max) | | 1.13 | 1.15 | 1.18 |
| | (γ'/γ-max)/(γ'/γ-min) | | 1.02 | 1.11 | 1.05 |
| Result of visual evaluation of sensitization processability | | | 4 | 3 | 3 |

| Remarks | | | Sample No. 104 Comparative example | 105 Comparative example | 106 Invention |
|---|---|---|---|---|---|
| Constitution of sample | Yellow dye in 12th layer | Compound | — | Emulsion dispersion of compound X-1 | Emulsion dispersion of compound X-2 |
| | | Addition amount g/m$^2$ | — | 0.24 g | 0.24 g |
| | Colloidal silver in 12th layer Addition amount of colloidal silver in 12th layer | | 0.78 g | 0.002 g | 0.002 g |
| Sensitometry data | Point-gamma at 1st development time 6' | γ-cyan | 1.50 | 1.58 | 1.55 |
| | | γ-magenta | 1.40 | 1.40 | 1.47 |
| | | γ-yellow | 1.43 | 1.45 | 1.37 |
| | Point-gamma at 1st development time 11' | γ'-cyan | 1.80 | 1.78 | 1.78 |
| | | γ'-magenta | 1.97 | 1.66 | 1.76 |
| | | γ'-yellow | 1.78 | 1.59 | 1.55 |
| | Speed difference between 6' and 11' | | 0.58 | 0.55 | 0.55 |
| | γ'/γ | cyan | 1.20 | 1.13 | 1.15 |
| | | magenta | 1.41 | 1.19 | 1.20 |
| | | yellow | 1.24 | 1.10 | 1.13 |
| | minimum of γ'/γ (γ'/γ-min) | | 1.20 | 1.10 | 1.13 |
| | maximum of γ'/γ (γ'/γ-max) | | 1.41 | 1.19 | 1.20 |
| | (γ'/γ-max)/(γ'/γ-min) | | 1.17 | 1.08 | 1.06 |
| Result of visual evaluation of sensitization processability | | | 1 | 2 | 3 |

The following is apparent from Table 2.

1. Regarding the above point-gamma's, the ratio of γ'/γ of magenta the sample not containing any yellow dye such as sample 104 does not fall within the range of the present invention. Thus, upon visual inspection of the image obtained by push-processing, it was found that the image was not favorable.

2. With respect to the yellow dye, oil soluble one such as that in sample 105 is not favorable, and solid dispersed dyes such as those in sample 106 (X-2 is identical with compound example V-49) and sample 101 are favorable.

3. With respect to the use amount of solid disperse dye, that employed in sample 101 is the most favorable.

Example 2

Preparation of samples 201 to 209

Samples 201 to 209 were prepared in the same manner as in the sample 101, except that the layers to which the compound of the general formula (I) was added and amounts thereof were changed as specified in Table 3. The point-gamma's and the ratio γ'/γ of these samples were determined in the same manner as in Example 1. The results are listed in Table 3.

TABLE 3

| Remarks | | | Sample No. 101 Invention | 201 Comparative example | 202 Invention | 203 Invention | 204 Invention |
|---|---|---|---|---|---|---|---|
| Constitution of sample | Compound of general formula I | Compound | Cpd-H | — | Cpd-H | Cpd-H | Cpd-H |
| | | Doped layer | 2nd layer | — | 2nd layer | 2nd layer | 2nd layer |
| | | Addition amount | 3.5 mg | — | 3.5 mg | 3.5 mg | 10 mg |
| | | Compound | Cpd-H | — | — | Cpd-H | Cpd-H |
| | | Doped layer | 9th layer | — | — | 9th layer | 9th layer |
| | | Addition amount | 3.5 mg | — | — | 3.5 mg | 10 mg |
| | | Compound | — | — | — | Cpd-H | — |
| | | Doped layer | — | — | — | 14th layer | — |
| | | Addition amount | — | — | — | 3.5 mg | — |
| Sensitometry data | Point-gamma at 1st development time 6' | γ-cyan | 1.58 | 1.70 | 1.65 | 1.58 | 1.55 |
| | | γ-magenta | 1.48 | 1.65 | 1.63 | 1.47 | 1.46 |
| | | γ-yellow | 1.35 | 1.55 | 1.51 | 1.33 | 1.37 |
| | Point-gamma at 1st development time 11' | γ'-cyan | 1.78 | 1.99 | 1.98 | 1.76 | 1.65 |
| | | γ'-magenta | 1.67 | 2.14 | 2.03 | 1.65 | 1.67 |
| | | γ'-yellow | 1.50 | 1.99 | 1.89 | 1.45 | 1.51 |
| | Speed difference between 6' and 11' | | 0.55 | 0.60 | 0.57 | 0.53 | 0.52 |
| | γ'/γ | cyan | 1.13 | 1.17 | 1.20 | 1.11 | 1.06 |
| | | magenta | 1.13 | 1.30 | 1.25 | 1.12 | 1.14 |
| | | yellow | 1.11 | 1.28 | 1.25 | 1.09 | 1.10 |
| | minimum of γ'/γ (γ'/γ-min) | | 1.11 | 1.17 | 1.20 | 1.09 | 1.06 |
| | maximum of γ'/γ (γ'/γ-max) | | 1.13 | 1.30 | 1.25 | 1.12 | 1.14 |
| | (γ'/γ-max)/(γ'/γ-min) | | 1.02 | 1.11 | 1.04 | 1.03 | 1.07 |
| Result of visual evaluation of sensitization processability | | | 4 | 1 | 2 | 4 | 3 |

| Remarks | | | Sample No. 205 Invention | 206 Invention | 207 Invention | 208 Invention | 209 Invention |
|---|---|---|---|---|---|---|---|
| Constitution of sample | Compound of general formula I | Compound | Cpd-H | X-3 | X-4 | Cpd-H | Cpd-H |
| | | Doped layer | 2nd layer | 2nd layer | 2nd layer | 4th layer | 5th layer |
| | | Addition amount | 1 mg | 3.5 mg | 3.5 mg | 3.5 mg | 3.5 mg |
| | | Compound | Cpd-H | X-3 | X-4 | Cpd-H | Cpd-H |
| | | Doped layer | 9th layer | 9th layer | 9th layer | 9th layer | 10th layer |
| | | Addition amount | 1 mg | 3.5 mg | 3.5 mg | 3.5 mg | 3.5 mg |
| | | Compound | — | — | — | Cpd-H | — |
| | | Doped layer | — | — | — | 13th layer | — |
| | | Addition amount | — | — | — | 3.5 mg | — |
| Sensitometry data | Point-gamma at 1st development time 6' | γ-cyan | 1.61 | 1.60 | 1.62 | 1.58 | 1.56 |
| | | γ-magenta | 1.50 | 1.46 | 1.46 | 1.48 | 1.48 |
| | | γ-yellow | 1.37 | 1.35 | 1.34 | 1.37 | 1.35 |
| | Point-gamma at 1st development time 11' | γ'-cyan | 1.84 | 1.80 | 1.82 | 1.68 | 1.82 |
| | | γ'-magenta | 1.67 | 1.74 | 1.77 | 1.59 | 1.79 |
| | | γ'-yellow | 1.58 | 1.50 | 1.50 | 1.48 | 1.50 |
| | Speed difference between 6' and 11' | | 0.58 | 0.57 | 0.59 | 0.53 | 0.53 |
| | γ'/γ | cyan | 1.14 | 1.13 | 1.12 | 1.06 | 1.17 |
| | | magenta | 1.11 | 1.19 | 1.21 | 1.07 | 1.21 |
| | | yellow | 1.15 | 1.11 | 1.12 | 1.08 | 1.11 |
| | minimum of γ'/γ (γ'/γ-min) | | 1.11 | 1.11 | 1.12 | 1.06 | 1.11 |
| | maximum of γ'/γ (γ'/γ-max) | | 1.15 | 1.19 | 1.21 | 1.08 | 1.21 |
| | (γ'/γ-max)/(γ'/γ-min) | | 1.04 | 1.07 | 1.08 | 1.02 | 1.09 |
| Result of visual evaluation of sensitization processability | | | 3 | 3 | 3 | 5 | 3 |

X-3

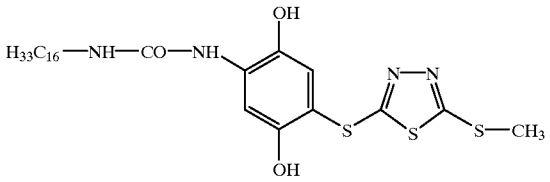

-continued

X-4

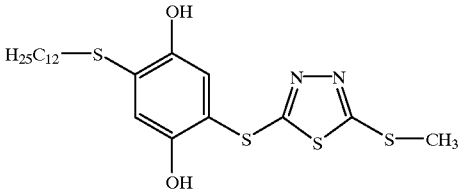

The following is apparent from Table 3.

1. Sample in which the compound of the general formula (I) is not employed, such as sample 201, fails to fall within the characteristic value (γ'/γ) range defined in the present invention. Thus, favorable image was not obtained by push-processing.

2. It is preferred that the compound of the general formula (I) be incorporated in the non color-sensitive layers next to each of three color-sensitive emulsion layer unit as in samples 101 and 203.

3. Especially, it is the most preferable to add the compound of the general formula (I) to the lowest-speed sublayer of each color-sensitive emulsion layer unit as in sample 208.

Example 3

Preparation of samples 301 to 309

Samples 301 to 309 were prepared in the same manner as in the sample 101, except that the layers to which the compound of the general formula (II) was added and amounts thereof were changed as specified in Table 4. The point-gamma and γ'/γ ratio of these samples were determined in the same manner as in Example 1. The results are listed in Table 4.

TABLE 4

| Remarks | | | Sample No. | | | | |
|---|---|---|---|---|---|---|---|
| | | | 101 Invention | 301 Invention | 302 Invention | 303 Invention | 304 Invention |
| Constitution of sample | Compound of general formula II | Compound | F-8 | F-8 | F-8 | F-8 | F-1 |
| | | Addition amount | Indicated in Table 1 | Indicated in Table 1 | Indicated in Table 1 | Indicated in Table 1 | Indicated in Table 1 |
| | | Doped layer | After grain formation but before chemical sensitization | Before coating | Immediately after chemical sensitization | After grain formation but before chemical sensitization | After grain formation but before chemical sensitization |
| | | Additon method | | | | | |
| Sensitometry data | Point-gamma at 1st development time 6' | γ-cyan | 1.58 | 1.62 | 1.58 | 1.60 | 1.60 |
| | | γ-magenta | 1.48 | 1.50 | 1.48 | 1.49 | 1.52 |
| | | γ-yellow | 1.35 | 1.41 | 1.35 | 1.37 | 1.40 |
| | Point-gamma at 1st development time 11' | γ'-cyan | 1.78 | 1.86 | 1.79 | 1.85 | 2.08 |
| | | γ'-magenta | 1.67 | 1.80 | 1.72 | 1.69 | 1.99 |
| | | γ'-yellow | 1.50 | 1.69 | 1.52 | 1.54 | 1.89 |
| | Speed difference between 6' and 11' | | 0.55 | 0.59 | 0.57 | 0.58 | 0.63 |
| | γ'/γ | cyan | 1.13 | 1.15 | 1.13 | 1.16 | 1.30 |
| | | magenta | 1.13 | 1.20 | 1.16 | 1.13 | 1.31 |
| | | yellow | 1.11 | 1.20 | 1.13 | 1.12 | 1.35 |
| | minimum of γ'/γ (γ'/γ-min) | | 1.11 | 1.15 | 1.13 | 1.12 | 1.30 |
| | maximum of γ'/γ (γ'/γ-max) | | 1.13 | 1.20 | 1.16 | 1.16 | 1.35 |
| | (γ'/γ-max)/(γ'/γ-min) | | 1.02 | 1.05 | 1.03 | 1.03 | 1.04 |
| Result of visual evaluation of sensitization processability | | | 4 | 2 | 3 | 3 | 1 |

| Remarks | | | Sample No. | | | | |
|---|---|---|---|---|---|---|---|
| | | | 305 Invention | 306 Invention | 307 Invention | 308 Invention | 309 Comparative |
| Constitution of sample | Compound of general formula II | Compound | F-8 | F-8 | F-8 | F-8 | F-8 |
| | | Addition amount | *1 | *2 | Increased up indicated in Table 1 | Decreased to indicated in Table 1 | — |
| | | Doped layer | After grain formation but before chemical sensitization | Before coating | After grain formation but before chemical sensitization | After grain formation but before chemical sensitization | — |
| | | Additon method | | | | | |
| Sensitometry data | Point-gamma at 1st development time 6' | γ-cyan | 1.54 | 1.62 | 1.58 | 1.58 | 1.62 |
| | | γ-magenta | 1.52 | 1.50 | 1.48 | 1.48 | 1.50 |
| | | γ-yellow | 1.40 | 1.40 | 1.35 | 1.35 | 1.40 |
| | Point-gamma at 1st development time 11' | γ'-cyan | 1.86 | 1.90 | 1.78 | 1.78 | 1.95 |
| | | γ'-magenta | 1.60 | 1.80 | 1.67 | 1.67 | 1.90 |
| | | γ'-yellow | 1.61 | 1.74 | 1.50 | 1.50 | 1.86 |
| | Speed difference between 6' and 11' | | 0.56 | 0.61 | 0.52 | 0.60 | 0.63 |
| | γ'/γ | cyan | 1.21 | 1.17 | 1.13 | 1.13 | 1.20 |
| | | magenta | 1.05 | 1.20 | 1.13 | 1.13 | 1.27 |
| | | yellow | 1.15 | 1.24 | 1.11 | 1.11 | 1.33 |

TABLE 4-continued

| | | | | | |
|---|---|---|---|---|---|
| minimum of γ'/γ (γ'/γ-min) | 1.05 | 1.17 | 1.11 | 1.11 | 1.20 |
| maximum of γ'/γ (γ'/γ-max) | 1.21 | 1.24 | 1.13 | 1.13 | 1.33 |
| (γ'/γ-max)/(γ'/γ-min) | 1.15 | 1.06 | 1.02 | 1.02 | 1.10 |
| Result of visual evaluation of sensitization processability | 2 | 1 | 3 | 3 | 1 |

*1: Compound F-8 in amounts of 1.5 mol was added to emulsion D, 1.6 mol was added to emulsion I, 1.2 mol was added to emulsion J, 1.7 mol was added to emulsion O and 1.2 mol was added to emulsion P.
*2: Compound F-8 in an amount of 5 mg was added to each of 3rd layer, 8th layer and 12th layer.

The following is apparent from Table 4.

1. The characteristic value (γ'/γ) range defined in the present invention cannot be met when replacement is made by a compound other than that of the general formula (II) as in sample 304, thereby disenabling obtaining favorable sensitization image.

2. The effect was not so large when the compound of the general formula (II) was added to a non-lightsensitive layer as in sample 306, compared with the samples when the compound was added to a light-sensitive sub-layer.

3. Although the compound of the general formula (II) is preferably added to an emulsion layer, the effect of the addition prior to coating as in sample 301 is slighter, and it is preferable to conduct the addition prior to chemical sensitization as in samples 101, 303, 305, 307 and 308 or immediately after chemical sensitization as in sample 302.

Example 4

Preparation of samples 401 to 408

Samples 401 to 408 were prepared in the same manner as the sample 101, except that the (100) face selective compound was used instead of the compound represent by general formula (II) as specified in Table 5. The point-gamma's and γ'/γ ratio of these samples were determined in the same manner as in Example 1. The results are listed in Table 5.

TABLE 5

| | Remarks | | Sample No. 101 Invention | 401 Comparative example | 402 Invention | 403 Invention | 404 Comparative example |
|---|---|---|---|---|---|---|---|
| Constitution of sample | Compound used instead of those represented by general formula II | Compound | B-7 | B-7 | B-7 | B-7 | B-7 |
| | | Addition amount | Indicated in Table 1 | Indicated in Table 1 | Indicated in Table 1 | Indicated in Table 1 | *1 |
| | | Doped layer | After grain formation but before chemical sensitization | Before coating | Immediately after chemical sensitization | After grain formation but before chemical sensitization | Before coating |
| | | Additon method | | | | | |
| Sensitometry data | Point-gamma at 1st development time 6' | γ-cyan | 1.58 | 1.58 | 1.58 | 1.58 | 1.58 |
| | | γ-magenta | 1.48 | 1.49 | 1.48 | 1.49 | 1.49 |
| | | γ-yellow | 1.35 | 1.40 | 1.35 | 1.37 | 1.40 |
| | Point-gamma at 1st development time 11' | γ'-cyan | 1.78 | 1.79 | 1.79 | 1.79 | 1.79 |
| | | γ'-magenta | 1.67 | 1.66 | 1.68 | 1.69 | 1.66 |
| | | γ'-yellow | 1.50 | 1.80 | 1.52 | 1.60 | 1.80 |
| | Speed difference between 6' and 11' | | 0.55 | 0.57 | 0.57 | 0.58 | 0.57 |
| | γ'/γ | cyan | 1.13 | 1.13 | 1.13 | 1.13 | 1.13 |
| | | magenta | 1.13 | 1.11 | 1.14 | 1.13 | 1.11 |
| | | yellow | 1.11 | 1.29 | 1.13 | 1.17 | 1.29 |
| | minimum of γ'/γ (γ'/γ-min) | | 1.11 | 1.11 | 1.13 | 1.13 | 1.11 |
| | maximum of γ'/γ (γ'/γ-max) | | 1.13 | 1.29 | 1.14 | 1.17 | 1.29 |
| | (γ'/γ-max)/(γ'/γ-min) | | 1.02 | 1.15 | 1.01 | 1.03 | 1.15 |
| Result of visual evaluation of sensitization processability | | | 4 | 1 | 4 | 3 | 1 |

| | Remarks | | Sample No. 405 Invention | 406 Invention | 407 Invention | 408 Comparative example |
|---|---|---|---|---|---|---|
| Constitution of sample | Compound used instead of those represented by general formula II | Compound | B-7 | B-7 | B-7 | — |
| | | Addition amount | *2 | Increased up to ⅓ × amount indicated in Table 1 | Decreased to indicated in Table 1 | — |
| | | Doped layer | 3 × amount | | | |
| | | Additon method | After grain formation but | After grain formation but | After grain formation but | — |

TABLE 5-continued

| | | | | | | |
|---|---|---|---|---|---|---|
| | | | before chemical sensitization | before chemical sensitization | before chemical sensitization | |
| Sensi-tometry data | Point-gamma at 1st development time 6' | γ-cyan | 1.58 | 1.58 | 1.58 | 1.58 |
| | | γ-magenta | 1.48 | 1.48 | 1.48 | 1.48 |
| | | γ-yellow | 1.35 | 1.38 | 1.35 | 1.34 |
| | Point-gamma at 1st development time 11' | γ'-cyan | 1.70 | 1.78 | 1.78 | 1.78 |
| | | γ'-magenta | 1.62 | 1.67 | 1.70 | 1.67 |
| | | γ'-yellow | 1.48 | 1.35 | 1.55 | 1.70 |
| | Speed difference between 6' and 11' | | 0.55 | 0.55 | 0.55 | 0.60 |
| | γ'/γ | cyan | 1.08 | 1.13 | 1.13 | 1.13 |
| | | magenta | 1.09 | 1.13 | 1.15 | 1.13 |
| | | yellow | 1.10 | 0.98 | 1.15 | 1.27 |
| | minimum of γ'/γ (γ'/γ-min) | | 1.08 | 0.98 | 1.13 | 1.13 |
| | maximum of γ'/γ (γ'/γ-max) | | 1.10 | 1.13 | 1.15 | 1.27 |
| | (γ'/γ-max)/(γ'/γ-min) | | 1.02 | 1.15 | 1.02 | 1.13 |
| Result of visual evaluation of sensitization processability | | | 5 | 3 | 3 | 1 |

*1: The compound B-7 was not added to emulsions A to C, F to I, and L to Q during preparation thereof, but 5 mg of compound B-7 was added to each of 3rd layer, 8th layer and 12th layer during coating thereof.
*2: Compound B-7 was added as indicated in Table 1 plus 0.5 mol/mol Ag added to each of emulsions D, E, J, K, P, Q and R.

It is apparent from Table 5 that any effect cannot be exerted by methods in which the addition is conducted to non light-sensitive layers as in sample 404 or in which the addition to emulsion layer is conducted just before coating as in sample 401, and that it is preferable to conduct the addition prior to chemical sensitization as in samples 101, 403, 405 to 407 or immediately after chemical sensitization of emulsion as in sample 402.

Example 5

Preparation of samples 501 to 509

Samples 501 to 509 were prepared in the same manner as the sample 101, except that the kind of colloidal silver and amounts thereof was changed as specified in Table 6. The point-gamma's and γ'/γ ratio of these samples were determined in the same manner as in Example 1. The results are listed in Table 6.

TABLE 6

| | | | Sample No. | | | | |
|---|---|---|---|---|---|---|---|
| Remarks | | | 101 Invention | 501 Invention | 502 Invention | 503 Invention | 504 Invention |
| Constitution of sample | Method of using colloidal silver | Color | Yellow | | | | |
| | | Doped layer | 3rd layer | | | | |
| | | Addition amount | 0.007 g | | | | |
| | | Color | Yellow | Yellow | | | Yellow |
| | | Doped layer | 8th layer | 8th layer | | | 8th layer |
| | | Addition amount | 0.01 g | 0.01 g | | | 0.01 g |
| | | Color | Yellow | Yellow | Yellow | | |
| | | Doped layer | 12th layer | 12th layer | 12th layer | | |
| | | Addition amount | 0.002 g | 0.002 g | 0.002 g | | — |
| Sensi-tometry data | Point-gamma at 1st development time 6' | γ-cyan | 1.58 | 1.58 | 1.58 | 1.54 | 1.57 |
| | | γ-magenta | 1.48 | 1.48 | 1.39 | 1.48 | 1.48 |
| | | γ-yellow | 1.35 | 1.35 | 1.35 | 1.35 | 1.35 |
| | Point-gamma at 1st development time 11' | γ'-cyan | 1.78 | 1.74 | 1.78 | 1.82 | 1.70 |
| | | γ'-magenta | 1.67 | 1.70 | 1.67 | 1.67 | 1.67 |
| | | γ'-yellow | 1.50 | 1.50 | 1.50 | 1.37 | 1.50 |
| | Speed difference between 6' and 11' | | 0.55 | 0.53 | 0.50 | 0.50 | 0.55 |
| | γ'/γ | cyan | 1.13 | 1.10 | 1.13 | 1.18 | 1.08 |
| | | magenta | 1.13 | 1.15 | 1.20 | 1.13 | 1.13 |
| | | yellow | 1.11 | 1.11 | 1.11 | 1.01 | 1.11 |
| | minimum of γ'/γ (γ'/γ-min) | | 1.11 | 1.10 | 1.11 | 1.01 | 1.08 |
| | maximum of γ'/γ (γ'/γ-max) | | 1.13 | 1.15 | 1.20 | 1.18 | 1.13 |
| | (γ'/γ-max)/(γ'/γ-min) | | 1.02 | 1.04 | 1.08 | 1.16 | 1.04 |
| Result of visual evaluation of sensitization processability | | | 4 | 2 | 2 | 2 | 2 |

| | | | Sample No. | | | | |
|---|---|---|---|---|---|---|---|
| Remarks | | | 505 Invention | 506 Invention | 507 Invention | 508 Invention | 509 Comparative example |
| Constitution of sample | Method of using colloidal silver | Color | Yellow | Yellow | Yellow | Yellow | Black |
| | | Doped layer | 3rd layer | 4th layer | 3rd layer | 3rd layer | 3rd layer |
| | | Addition amount | 0.007 g | 0.007 g | 0.014 g | 0.003 g | 0.007 g |

TABLE 6-continued

| | | | | | | | |
|---|---|---|---|---|---|---|---|
| | | Color | | Yellow | Yellow | Yellow | Black |
| | | Doped layer | | 9th layer | 8th layer | 8th layer | 8th layer |
| | | Addition amount | | 0.01 g | 0.02 g | 0.005 g | 0.01 g |
| | | Color | | Yellow | Yellow | Yellow | Black |
| | | Doped layer | | 13th layer | 13th layer | 13th layer | 13th layer |
| | | Addition amount | | 0.002 g | 0.004 g | 0.001 g | 0.002 g |
| Sensi- | Point-gamma at | γ-cyan | 1.59 | 1.55 | 1.58 | 1.58 | 1.58 |
| tometry | 1st development | γ-magenta | 1.48 | 1.47 | 1.47 | 1.48 | 1.49 |
| data | time 6' | γ-yellow | 1.35 | 1.35 | 1.32 | 1.35 | 1.40 |
| | Point-gamma at | γ'-cyan | 1.78 | 1.80 | 1.75 | 1.70 | 1.42 |
| | 1st development | γ'-magenta | 1.65 | 1.67 | 1.66 | 1.72 | 1.66 |
| | time 11' | γ'-yellow | 1.37 | 1.50 | 1.54 | 1.45 | 1.79 |
| | Speed difference between 6' and 11' | | 0.55 | 0.59 | 0.53 | 0.53 | 0.50 |
| | γ'/γ | cyan | 1.12 | 1.16 | 1.11 | 1.08 | 0.90 |
| | | magenta | 1.11 | 1.14 | 1.13 | 1.16 | 1.11 |
| | | yellow | 1.01 | 1.11 | 1.17 | 1.07 | 1.28 |
| | minimum of γ'/γ (γ'/γ-min) | | 1.01 | 1.11 | 1.11 | 1.07 | 0.90 |
| | maximum of γ'/γ (γ'/γ-max) | | 1.12 | 1.16 | 1.17 | 1.16 | 1.28 |
| | (γ'/γ-max)/(γ'/γ-min) | | 1.10 | 1.05 | 1.05 | 1.08 | 1.42 |
| Result of visual evaluation of sensitization processability | | | 2 | 3 | 3 | 3 | 1 |

The following is apparent from Table 6.

1. The effect obtained by the use of black colloidal silver such as in Sample 509 was not apparent.

2. The effect obtained by adding the colloidal silver to three layers was larger than the sample in which the colloidal silver was added to one layer as in samples 502, 504 and 505, and to two layers as in samples 501.

3. It is preferable to incorporate yellow colloidal silver in the layers next to each color-sensitive layer as in samples 101 and 506 to 508, and it is the most preferable to conduct the addition to the layers next to the lowest-speed layer of each color-sensitive layer unit as in samples 101 and 508.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color reversal lightsensitive material comprising a transparent support and, superimposed thereon, a blue-sensitive emulsion layer unit, a green-sensitive emulsion layer unit and a red-sensitive emulsion layer unit, each of these units comprising at least two emulsion sub-layers having the same color sensitivity but different speeds from each other, wherein said material contains a yellow dye in an amount of 0.15 to 1.0 g/m$^2$ and satisfies the relationship:

$$0.9 \leqq \gamma'/\gamma \leqq 1.25$$

wherein γ and γ' each represent a point-gamma value of a portion of said material giving a magenta density of 1.0 when said material was subjected to a development processing comprising an image-wise exposure step, a black and white development step, a reversal processing step, a color development step and a desilvering step thereby forming color reversal images, provided that γ is the point-gamma value attained when a period of the black and white development step was set to a standard period, and γ' is the point-gamma value attained when the period of the black and white development step was prolonged to attain a higher speed of 0.5 log E.

2. The material according to claim 1, wherein said material further comprises means for releasing a development inhibitor during the development processing.

3. The material according to claim 2, wherein said means for releasing a development inhibitor is a DIR compound represented by the general formula (I):

$$A—(L)_n—(G)_m—(Time)_t—X \quad (I)$$

wherein A represents a redox mother nucleus or a precursor thereof and represents a group oxidized during the development processing to thereby enable, for the first time, splitting off —(Time)$_t$—X; Time represents a group that can release X after —(Time)$_t$—X is released; X represents a development inhibitor; L represents a divalent linkage group; G represents an acid group; and each of n, m and t is 0 or 1, provided that m is not 0 when n=1.

4. The material according to claim 1, wherein $1\times10^{-4}$ to $5\times10^{-3}$ g/m$^2$ of at least one compound selected from the group consisting of compounds represented by the general formula (II) given below and compounds that selectively adsorb onto (100) faces of each silver halide grain, is contained in at least one sub-layer having the lowest speed, (II)

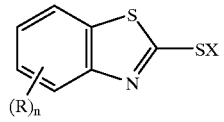

wherein X represents a hydrogen atom or an alkali metal atom; R represents a hydrogen atom, a halogen atom or an alkyl group having 1 to 5 carbon atoms; and n represents an integer from 1 to 4.

5. The material according to claim 2, wherein $1\times10^{-4}$ to $5\times10^{-3}$ g/m$^2$ of at least one compound selected from the group consisting of compounds represented by the general formula (II) given below and compounds that selectively adsorb onto (100) faces of each silver halide grain, is contained in at least one sub-layer having the lowest speed, (II)

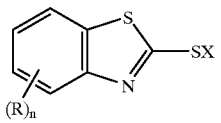

wherein X represents a hydrogen atom or an alkali metal atom; R represents a hydrogen atom, a halogen atom or an alkyl group having 1 to 5 carbon atoms; and n represents an integer from 1 to 4.

6. The material according to claim 3, wherein $1\times10^{-4}$ to $5\times10^{-3}$ g/m$^2$ of at least one compound selected from the group consisting of compounds represented by the general formula (II) given below and compounds that selectively adsorb onto (100) faces of each silver halide grain, is contained in at least one sub-layer having the lowest speed, (II)

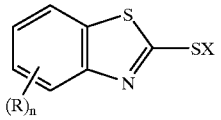

wherein X represents a hydrogen atom or an alkali metal atom; R represents a hydrogen atom, a halogen atom or an alkyl group having 1 to 5 carbon atoms; and n represents an integer from 1 to 4.

7. The material according to claim 1, wherein colloidal silver is further contained in at least one layer selected from the group consisting of the sub-layer having the lowest speed and a nonlightsensitive layer next to the sub-layer having the lowest speed.

8. The material according to claim 2, wherein colloidal silver is further contained in at least one layer selected from the group consisting of the sub-layer having the lowest speed and a nonlightsensitive layer next to the sub-layer having the lowest speed.

9. The material according to claim 3, wherein colloidal silver is further contained in at least one layer selected from the group consisting of the sub-layer having the lowest speed and a nonlightsensitive layer next to the sub-layer having the lowest speed.

10. The material according to claim 4, wherein colloidal silver is further contained in at least one layer selected from the group consisting of the sub-layer having the lowest speed and a nonlightsensitive layer next to the sub-layer having the lowest speed.

11. The material according to claim 5, wherein colloidal silver is further contained in at least one layer selected from the group consisting of the sub-layer having the lowest speed and a nonlightsensitive layer next to the sub-layer having the lowest speed.

12. The material according to claim 6, wherein colloidal silver is further contained in at least one layer selected from the group consisting of the sub-layer having the lowest speed and a nonlightsensitive layer next to the sub-layer having the lowest speed.

* * * * *